US006248420B1

(12) United States Patent
Brandt et al.

(10) Patent No.: US 6,248,420 B1
(45) Date of Patent: Jun. 19, 2001

(54) METHOD OF PRODUCING A MINERAL FIBER-INSULATING WEB, A PLANT FOR PRODUCING A MINERAL FIBER-INSULATING WEB, AND A MINERAL FIBER-INSULATED PLATE

(75) Inventors: Kim Brandt, Karlslunde; Erik Holtze, Ferritslev, both of (DK)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 08/926,567

(22) Filed: Sep. 10, 1997

Related U.S. Application Data

(63) Continuation of application No. 08/481,288, filed as application No. PCT/DK94/00027 on Jan. 14, 1994, now abandoned.

(30) Foreign Application Priority Data

Jan. 14, 1993 (DK) ..... 0035/93

(51) Int. Cl.[7] ..... B32B 5/12

(52) U.S. Cl. ..... 428/113; 428/121; 428/212; 428/298.1; 428/299.4

(58) Field of Search ..... 442/366, 367, 442/368, 391; 428/113, 121, 212, 298.1, 299.4

(56) References Cited

U.S. PATENT DOCUMENTS 4,128,678 * 12/1978 Metcalfe et al. ..... 428/119

FOREIGN PATENT DOCUMENTS 938294 9/1948 (FR) .
441764 11/1985 (SE) .
452040 11/1987 (SE) .

* cited by examiner

*Primary Examiner*—Elizabeth M. Cole
(74) *Attorney, Agent, or Firm*—Merchant & Gould P.C.

(57) ABSTRACT

A method for producing a mineral fiber-insulating web comprises the steps of firstly producing a first non-woven mineral fiber-web being a loosely compacted mineral fiber web of a low area weight. The first material fiber web contains mineral fibers arranged generally in the longitudinal direction of the mineral fiber web. Secondly, the first material fiber web is moved in the longitudinal direction of the web and folded transversely relative to the longitudinal direction and parallel with a transversal direction of the first mineral fiber web, so as to produce a second mineral fiber-web containing mineral fibers arranged generally perpendicular to the longitudinal and transversal directions. Thereupon, the folded mineral fiber web is cured for bonding the mineral fibers together so as to produce the mineral fiber-insulating web comprising a central body containing mineral fibers arranged generally perpendicular to the longitudinal direction of the mineral fiber web.

3 Claims, 10 Drawing Sheets

Fig. 5a
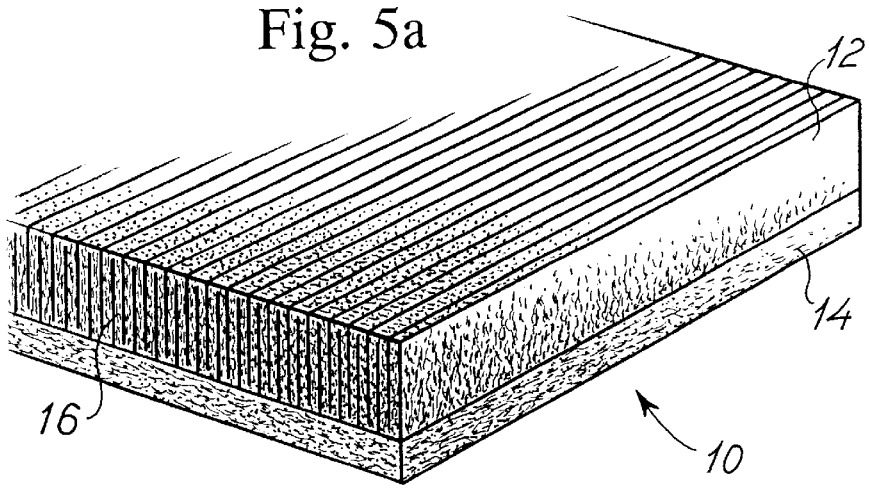
Fig 5b
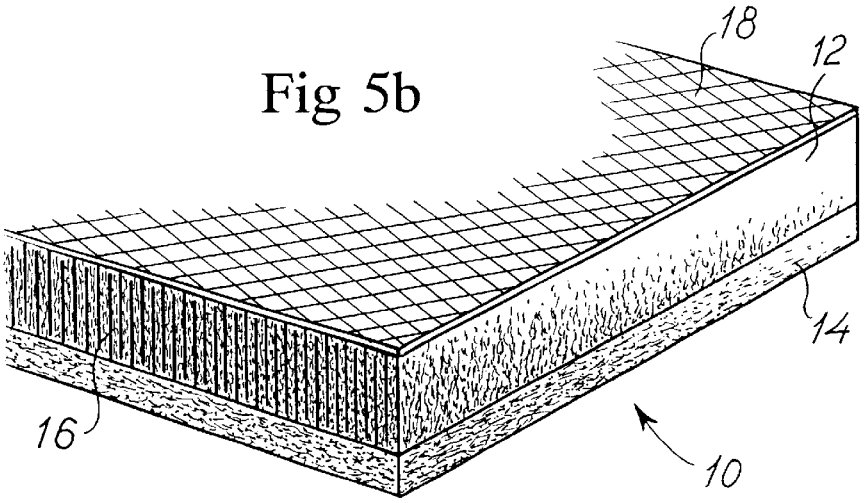
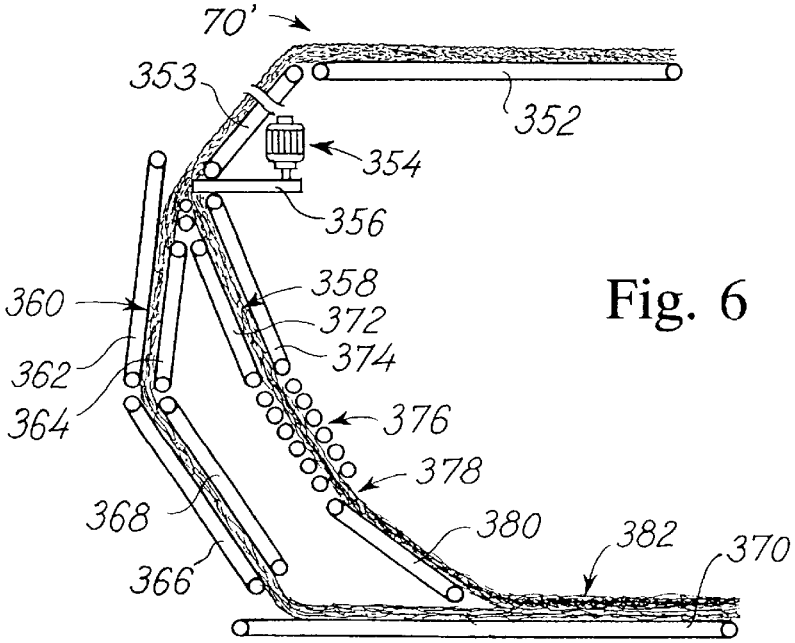
Fig. 6

METHOD OF PRODUCING A MINERAL FIBER-INSULATING WEB, A PLANT FOR PRODUCING A MINERAL FIBER-INSULATING WEB, AND A MINERAL FIBER-INSULATED PLATE

This is a Continuation of application Ser. No. 08/481,288, filed Aug. 18, 1995, now abandoned which is a U.S. National Stage application based on PCT/DK94/00027, International Filing Date Jan. 14, 1994, citing priority from Danish application No. 0035/93, filed Jan. 14, 1993.

FIELD OF THE INVENTION

The present invention generally relates to the technical field of producing mineral fiber-insulating plates. Mineral fibers generally comprise fibers such as rockwool fibers, glass fibers, etc. More precisely, the present invention relates to a novel technique of producing a mineral fiber-insulating web from which mineral fiber-insulating plates are cut. The mineral fiber-insulating plates produced from the mineral fiber-insulating web produced in accordance with the present invention exhibit advantageous characeristics as to mechanical performance, such as modulus of elasticity and strength, low weight and good thermal-insulating property.

BACKGROUND OF THE INVENTION

Mineral fiber-insulating webs are normally hitherto produced as homogeneous webs, i.e. webs in which the mineral fibers of which the mineral fiber-insulating web is composed, are generally orientated in a single predominant orientation which is determined by the orientation of the production line on which the mineral fiber-insulating web is produced and transmitted during the process of producing the mineral fiber-insulating web. The product made from a homogeneous mineral fiber-insulating web exhibits characteristics which are determined by the integrity of the mineral fiber-insulating web and which are predominantly determined by the binding of the mineral fibers within the mineral fiber-insulating plate produced from the mineral fiber-insulating web, and further predominantly determined by the area weight or density of the mineral fibers of the mineral fiber-insulating plate.

The advantageous characteristics of mineral fiber-insulating plates of a different structure has to some extent already been realized as techniques for the production of mineral fiber-insulating plates in which the mineral fibers are orientated in an overall orientation different from the orientation determined by the production line, has been devised, vide Published International Patent Application, International Application No. PCT/DK91/00383, International Publication No. WO92/10602, U.S. Pat. No. 4,950,355, Published International Patent Application, International Application No. PCT/DK87/00082, International Publication No. WO88/00265, French Patent No. 938294, U.S. Pat. No. 3,230,955 and Swedish Patent No. 452.040. Reference is made to the above patent applications and patents, and the above U.S. patents are hereby incorporated in the present specification by reference.

From the above published international patent application, International Publication No. WO92/10602, a method of producing an insulating mineral fiber plate composed of interconnected rod-shaped mineral fiber elements is known. The method includes cutting a continuous mineral fiber web in the longitudinal direction thereof in order to form lamellae, cutting the lamellae into desired lengths, turning the lamellae 90° about the longitudinal axis and bonding the lamellae together for forming the plate. The method also includes a step of curing the continuous mineral fiber web, or alternatively the plate composed of the individual lengths of lamellae bonded together for the formation of the plate.

From the above-mentioned published international patent application, International Publication No. WO88/00255, a method of folding a continuous mineral fiber web in a transversal direction relative to the longitudinal direction of the mineral fiber web is known for the formation of an undulated mineral fiber web. Dependent of the origin of the mineral fiber web from which the undulated mineral fiber web is produced, the undulated mineral fiber web may include mineral fibers orientated along the undulations or perpendicular to the undulations.

From French patent No. 938294 and U.S. Pat. No. 3,230,995, techniques of producing mineral fiber boards or plates composed of rod-shaped elements are known, which techniques are similar to the technique described in the above first-mentioned international patent application. Thus, according to the techniques described in the above French and U.S. patents, a board or plate of a mineral fiber material is cut into lengths of rod-shaped elements which are thereupon turned and reassembled into a composite rod-shaped mineral fiber plate structure. These well-known prior art techniques involve a separate step of bonding the rod-shaped lamellae together by means of an appropriate bonding agent or foamed agent as described in the above-mentioned U.S. patent.

SUMMARY OF THE INVENTION

An object of the present invention is to provide a novel method of producing a mineral fiber-insulating web from which mineral fiber-insulating plates may be cut which method renders it possible in an online production plant to produce mineral fiber-insulating plates which are of a composite structure providing distinct advantages as compared to the prior art mineral fiber-containing plates.

A particular advantage of the present invention relates to the novel mineral fiber-insulating plate according to the present invention and produced in accordance with the method according to the present invention which as compared to prior art mineral fiber-insulating plates contains less mineral fibers and is consequently less costly than the prior art mineral fiber-insulating plates, still exhibiting advantages as compared to the prior art mineral fiber-insulating plates relating to mechanical strength and thermal-insulating properties.

A particular feature of the present invention relates to the fact that the novel mineral fiber-insulating plate according to the present invention and produced in accordance with the method according to the present invention is produceable from less mineral fibers or less material as compared to the prior art mineral fiber-insulating plate still providing the same properties as the prior art mineral fiber-insulating plate regarding mechanical strength and thermal-insulating properties, thus, providing a more lightweight and more compact mineral fiber-insulating plate product as compared to the prior art mineral fiber-insulating plate product reducing transport, storage and handling costs.

The above object, the above advantage and the above feature together with numerous other objects, advantages and features which will be evident from the below detailed description of present preferred embodiments of the invention are obtained by a method according to the present invention comprising the following steps:

a) producing a first non-woven mineral fiber web defining a first longitudinal direction parallel with the first mineral fiber web and a second transversal direction parallel with the first mineral fiber web, the first mineral fiber web containing mineral fibers arranged generally in the first longitudinal direction thereof and including a first heat-curable bonding agent, the first mineral fiber web being a loosely compacted mineral fiber web of a low area weight, such as an area weight of 50–1500 g/m$^2$, e.g. 100–1200 g/m$^2$, such as 200–600 g/m$^2$ or 600–1200 g/m$^2$, b) moving the first mineral fiber web in the first longitudinal direction of the first mineral fiber web, c) folding the first mineral fiber web transversely relative to the first longitudinal direction and parallel with the second transversal direction so as to produce a second non-woven mineral fiber web, the second mineral fiber web comprising a central body containing mineral fibers arranged generally perpendicular to the first longitudinal direction and the second transversal direction, d) moving the second mineral fiber web in the first longitudinal direction, and e) introducing the second mineral fiber web into a curing oven for hardening the first curable agent so as to cause the mineral fibers of the second mineral fiber web to bond to one another, thereby forming the mineral fiber-insulating web.

In accordance with the technique described in the above-mentioned published international patent application, application No. PCT/DK91/00383, publication No. WO92/10602, the first and second non-woven mineral fiber webs are preferably exposed to compacting and compression in order to provide more compact and more homogeneous mineral fiber webs. The compacting and compression may include height compression, longitudinal compression, transversal compression and combinations thereof. Thus, the method according to the present invention preferably further comprises the additional step of height-compressing the first non-woven mineral fiber web produced in step a) and preferably produced from the basic non-woven mineral fiber web as described above.

Further preferably, the method according to the present invention may comprise the additional step of longitudinally compressing the first non-woven mineral fiber web produced in step a) and additionally or alternatively the additional step of longitudinally compressing the second non-woven mineral fiber web produced in step c). By performing a longitudinal compression, the mineral fiber web exposed to the longitudinal compression is made more homogeneous, resulting in an overall improvement of the mechanical performance and, in most instances, the thermal-insulating property of the longitudinally compressed mineral fiber web as compared to a non-longitudinally compressed mineral fiber web.

As will be evident from the detailed description below of presently preferred embodiments of the present invention, the mineral fiber-insulating plates produced in accordance with the method according to the present invention exhibit surprisingly improved mechanical properties and mechanical performance, provided the second non-woven mineral fiber web produced in step c) is exposed to transversal compression, producing a homogenization of the mineral fiber structure of the second non-woven mineral fiber web. The transversal compression of the second non-woven mineral fiber web results in a remarkable improvement of the mechanical properties and performance of the final mineral fiber-insulating plates produced from the second non-woven mineral fiber web, which improvement is believed to originate from a mechanical repositioning of the mineral fibers of the second non-woven mineral fiber web, as the second non-woven mineral fiber web is exposed to the transversal compression, by which repositioning the mineral fibers of the second non-woven mineral fiber web are evenly distributed throughout the uncured mineral fiber web.

According to the presently preferred embodiment of the method according to the present invention, the folding of step c) advantageously comprises the step of producing ondulations extending perpendicular to the first longitudinal direction and parallel with the second transversal direction. As the loosely-compacted mineral fiber web of a low area weight is folded in accordance with the teachings of the present invention, the fibers of the second mineral fiber web are arranged generally perpendicular to the first longitudinal direction and the second transversal direction. Furthermore, the loose compactness and low area weight of the second mineral fiber web produced from the first mineral fiber web by the folding of the first mineral fiber web result in the second mineral fiber web being to a great extent composed of individual segments arranged parallel with one another and perpendicular to the first longitudinal direction and the second transversal direction, as, due to the folding of the first mineral fiber web, the individual segments of the second mineral fiber web are separated from one another, eliminating to any substantial extent any transition segments interconnecting two adjacent segments of the second mineral fiber web, which transition segments would extend parallel with the first longitudinal direction and the second transversal direction and consequently not include mineral fibers arranged generally in the overall orientation of the second mineral fiber web.

According to a further, additional or alternative embodiment of the method according to the present invention, the method further comprises the following steps substituting step e):

f) producing a third non-woven mineral fiber web defining a third direction parallel with the third mineral fiber web, the third mineral fiber web containing mineral fibers arranged generally in the third direction and including a second heat-curable bonding agent, the third mineral fiber web being a mineral fiber web of a higher compactness as compared to the second mineral fiber web, g) adjoining the third mineral fiber web to the second mineral fiber web in facial contact therewith for producing a fourth composite mineral fiber web, and h) introducing the fourth composite mineral fiber web into a curing oven for hardening the first and second curable agents so as to cause the mineral fibers of the fourth composite mineral fiber web to bond to one another, thereby forming the mineral fiber-insulating web.

The third non-woven mineral fiber web which is adjoined to the second mineral fiber web in step g) may constitute a separate mineral fiber web. Thus, the first and the-third mineral fiber webs may be produced by separate production lines which are joined together in step g).

In accordance with a further embodiment of the method according to the present invention, the third non-woven mineral fiber web is produced by separating a surface segment layer of the first mineral fiber web therefrom and by compacting the surface segment layer for producing the third mineral fiber web.

The third mineral fiber web may additionally be produced by compacting the surface segment layer comprising the step of folding the surface segment layer so as to produce the third mineral fiber web containing mineral fibers arranged generally orientated transversely relative to the longitudinal direction of the third mineral fiber web.

The method according to the present invention preferably further comprises the additional step similar to step j) of producing a fifth non-woven mineral fiber web similar to the third mineral fiber web, and the step of adjoining in step g) the fifth mineral fiber web to the second mineral fiber web in facial contact therewith and so as to sandwich the second mineral fiber web between the third and fifth mineral fiber web in the fourth mineral fiber web. By producing a fifth non-woven mineral fiber web an integral composite mineral fiber structure of the fourth mineral fiber web is accomplished in which structure, the central body originating from the second mineral fiber web is sandwiched between opposite compacted surface layers constituted by the third and the fifth mineral fiber webs.

The step of folding the first mineral fiber web is preferably carried out so as to produce continuous ondulation extending in the first longitudinal direction of the first mineral fiber web in order to produce an accurately structured, folded second mineral fiber web from which the surface layer(s) are easily separated.

Provided the third mineral fiber web is provided as surface layers separated from the second mineral fiber web, the mineral fibers of the third mineral fiber web are as discussed above generally orientated along the first longitudinal direction. Consequently, the third direction may coincide with the first longitudinal direction.

Provided the third non-woven mineral fiber web is produced by a separate production line, the third direction may be of any arbitrary orientation, e.g. be identical to the first longitudinal direction and consequently, be perpendicular to the second transversal direction, or alternatively be identical to the second transversal direction and consequently, be perpendicular to the first longitudinal direction.

According to a particular, advantageous embodiment of the method according to the present invention, the method further comprises the following steps prior to step c):

i) producing a sixth non-woven mineral fiber web defining a fourth longitudinal direction parallel with the sixth mineral fiber web, the sixth mineral fiber web containing mineral fibers and including a third curable bonding agent, the sixth mineral fiber web being a mineral fiber web of a higher compactness as compared to the first mineral fiber web, and j) adjoining the sixth mineral fiber web to the first mineral fiber web produced in step a) in facial contact therewith, prior to step c), for producing a seventh composite mineral fiber web to be folded in step c) for producing the second non-woven mineral fiber web, and step e) also including curing the third curable bonding agent.

According to the above-defined embodiment of the method according to the present invention, an integral composite product is produced as the sixth mineral fiber web is adjoined to the first mineral fiber web prior to the processing of the seventh composite mineral fiber web in step d) for producing the second non-woven mineral fiber web in accordance with the present invention.

The sixth non-woven mineral fiber web, which is adjoined to the first mineral fiber web in step j), may constitute a separate mineral fiber web. Thus the first and sixth mineral fiber webs may be produced on separate production lines which are joined together in step j).

In accordance with a further embodiment of the method according to the present invention, the sixth non-woven mineral fiber web is produced by separating a separate layer of the first mineral fiber web therefrom and by compacting the separate layer for producing the sixth mineral fiber web.

The sixth non-woven mineral fiber web may be produced by separating a separate layer from the first mineral fiber web, and may be produced as a surface layer or a side segment layer. Furthermore the surface layer may, provided the separate layer from which the sixth mineral fiber web is produced is provided as a surface layer of the first mineral fiber web, be produced as a top or bottom surface layer separated from the mineral fiber web-from which the separate layer is separated.

The compacting of the separate layer from which the sixth mineral fiber web is produced may, according to a further embodiment of the method according to the present invention, comprise the step of folding the separate layer.

The method according to the present invention may further preferably and advantageously comprise the step of applying a covering to a side surface or both side surfaces of the first mineral fiber web and/or applying a covering to a side surface or both side surfaces of the second non-woven mineral fiber web and/or applying a covering to a side surface or both side surfaces of the fourth mineral fiber web. Furthermore, a covering may be applied to the sixth non-woven mineral fiber web prior to the step j) of adjoining the sixth mineral fiber web to the first mineral fiber web, providing a composite seventh mineral fiber web including a covering applied to a top or a bottom surface thereof or interlayered between the sixth and first mineral fiber webs of the seventh composite mineral fiber web. The covering constituting an integral component of the seventh composite mineral fiber web is also folded in step c) and produces interlayered coverings within the structure of the second non-woven mineral fiber web. The covering may be a foil of a plastics material, such as a continuous foil, a woven or non-woven mesh, or alternatively a foil of a non-plastics material, such as a paper or cloth material, or a mesh of metal wire or wires. The mineral fiber-insulating web produced in accordance with the method according to the present invention may, as discussed above, be provided with two oppositely arranged mineral fiber webs sandwiching a central body of the composite mineral fiber-insulating web. Provided the mineral fiber-insulating web is produced as a three-layer assembly, one or both outer side surfaces may be provided with similar or identical surface coverings.

The step e) of curing the first curable bonding agent and optionally the second and third curable bonding agents as well may, dependent on the nature of the curable bonding agent or agents, be carried out in numerous different ways, e.g. by simply exposing the curable bonding agent or agents to a curing gas or a curing atmosphere, such as the atmosphere, by exposing the curable bonding agent or agents to radiation, such as UV radiation or IR radiation. Provided the curable bonding agent or agents are a heat-curable bonding agents, such as conventional resin-based bonding agents normally used within the mineral fiber industry, the process of curing the curable bonding agent or agents includes the step of introducing the mineral fiber web to be cured into a curing oven. Consequently, the curing process is performed by means of a curing oven. Further alternative curing appliances may comprise IR radiators, microwave radiators, etc.

From the cured mineral fiber-insulating web, plate segments are preferably cut by cutting the cured non-woven third or fifth composite mineral fiber web into plate segment in a separate production step.

The method according to the present invention may further comprise the additional step of compressing the fourth composite mineral fiber web prior to curing the fourth composite mineral fiber web. The compressing of the fourth composite mineral fiber web may comprise height compression, longitudinal compression and/or transversal compression. By compressing the fourth composite mineral fiber web, the homogenity of the final product is believed to be improved as the compressing of the fourth composite mineral fiber web produces a homogenizing effect on the central body of the fourth composite mineral fiber web, which central body is constituted by the central body of the second non-woven mineral fiber web.

The above object, the above advantage and the above features together with numerous other objects, advantages and features is furthermore obtained by means of a plant for producing a mineral fiber-insulating web, comprising:

a) first means for producing a first non-woven mineral fiber web defining a first longitudinal direction parallel with the first mineral fiber web and a second transversal direction parallel with the first mineral fiber web, the first mineral fiber web being produced containing mineral fibers arranged generally in the first longitudinal direction thereof and including a first heat-curable bonding agent, the first mineral fiber web being a loosely compacted mineral fiber web of a low area weight, such as an area weight of 50–1500 g/m$^2$, e.g. 100–1200 g/m$^2$, such as 200–600 g/m$^2$ or 600–1200 g/m$^2$, b) second means for moving the first mineral fiber web in the first longitudinal direction of the first mineral fiber web, c) third means for folding the first mineral fiber web transversely relative to the first longitudinal direction and parallel with the second transversal direction so as-to produce a second non-woven mineral fiber web, the second mineral fiber web comprising a central body containing mineral fibers arranged generally perpendicular to the first longitudinal direction and the second transversal direction, d) fourth means for moving the second mineral fiber web in the first longitudinal direction, and e) fifth means for introducing the second mineral fiber web into a curing oven for hardening the first curable agent so as to cause the mineral fibers of the second mineral fiber web to bond to one another, thereby forming the mineral fiber-insulating web.

The plant according to the present invention may advantageously comprise any of the above features of the method according to the present invention.

The above object, the above advantage and the above features together with numerous other objects, advantages and features is furthermore obtained by means of a mineral fiber-insulating plate according to the present invention, which mineral fiber-insulating defines longitudinal direction and comprises:

a central body containing mineral fibers, a surface layer containing mineral fibers, the central body and the surface layer being adjoined in facial contact with one another, the mineral fibers of the central body being arranged generally perpendicularly to the longitudinal direction and perpendicularly to the surface layer, the mineral fibers of the surface layer being arranged generally in a direction parallel with the longitudinal direction, the surface layer being of a higher compactness as compared to the central body, and the fibers of the central body and the mineral fibers of the surface layer being bonded together in an integral structure solely through hardened bonding agents hardened in a single hardening process and initially present in uncured, non-woven mineral fiber webs from which the central body and the surface layer are produced.

The mineral fiber-insulating plate according to the present invention preferably comprises opposite surface layers of similar structure sandwiching the central body in the integral structure of the mineral fiber-insulating plate.

According to a particular, advantageous embodiment of the mineral fiber plate according to the present invention, the central body includes lamellae arranged generally perpendicularly to the longitudinal direction and interconnected through mineral fiber layers of a higher mineral fiber compactness as compared to the lamellae. The mineral fiber layers of higher mineral fiber compactness may include mineral fibers arranged or orientated along any arbitrary direction independent of the arrangement or orientation of the mineral fibers of the lamellae.

DESCRIPTION OF THE DRAWINGS

The present invention will now be further described with reference to the drawings, in which

FIG. 5*a* is a schematic, sectional and perspective view of a first embodiment of a mineral fiber-insulating plate produced in accordance with the technique disclosed in FIG. 1, FIG. 5*b* is a schematic, sectional and perspective view of a second embodiment of a mineral fiber-insulating plate produced in accordance with the technique disclosed in FIG. 1, FIG. 6 is a schematic and perspective view illustrating an initial production step of producing a combined mineral fiber web of two layers of different compactness to be processed in the production plant shown in FIG. 1 in accordance with the teachings of the present invention.

DETAILED DESCRIPTION OF THE PREFERRED EMBODIMENT

Figures 1, 2:
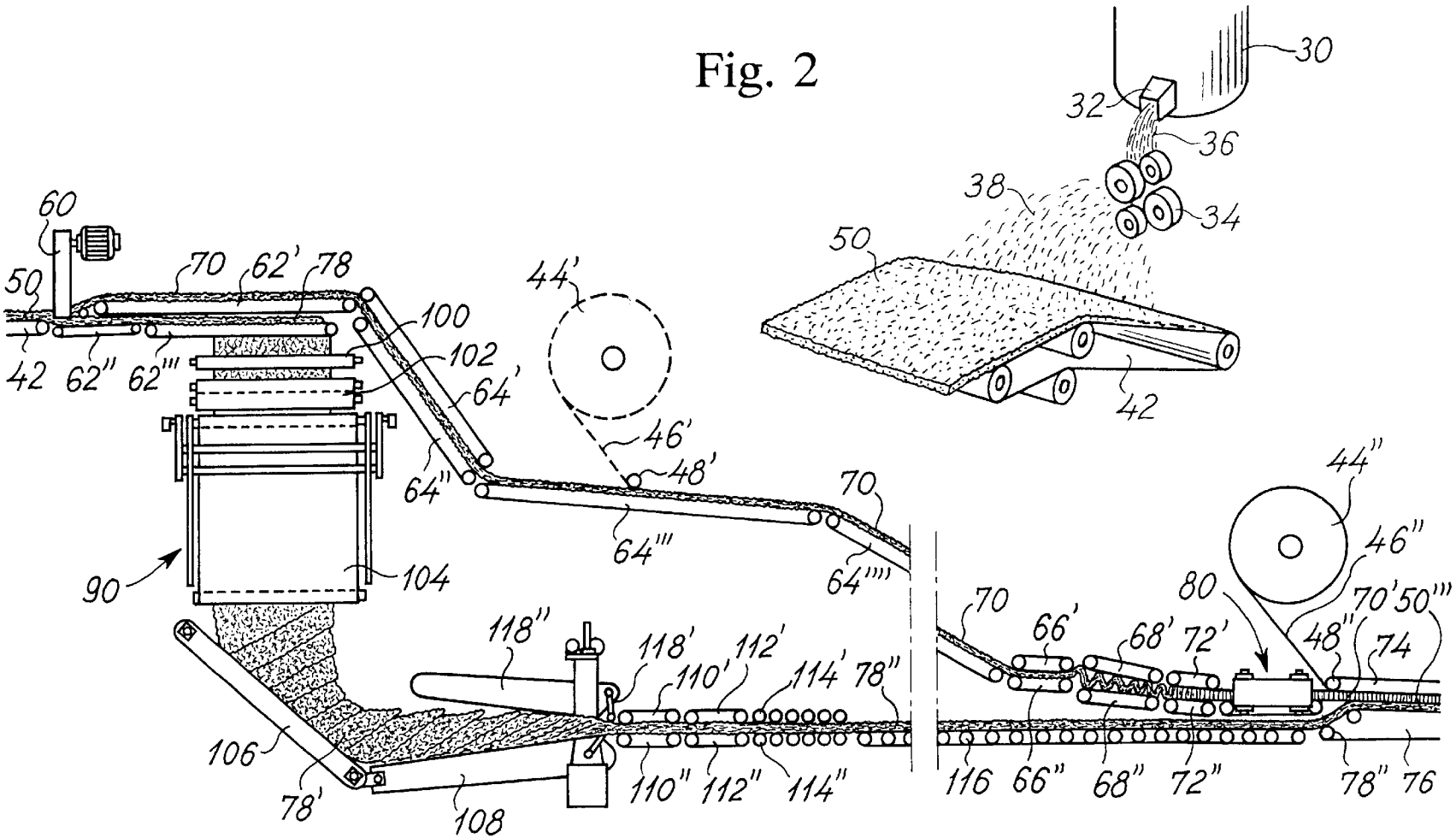
FIG. 1 is a schematic and perspective view illustrating a production plant for the production of a mineral fiber-insulating web according to the present invention.
FIG. 2 is a schematical and perspective view illustrating a first production step of producing a mineral fiber-insulating web from a mineral fiber forming melt.

In FIG. 2, a first step of producing a mineral fiber-insulating web is disclosed. The first step involves the formation of mineral fibers from a mineral fiber forming melt which is produced in a furnace 30 and which is supplied from a spout 32 of the furnace 30 to a total of four rapidly rotating spinning-wheels 34 to which the mineral fiber forming melt is supplied as a mineral fiber forming melt stream 36. As the mineral fiber forming melt stream 36 is supplied to the spinning-wheels 34 in a radial direction relative thereto, a cooling gas stream is simultaneously supplied to the rapidly rotating spinning-wheels 34 in the axial direction thereof causing the formation of individual mineral fibers which are expelled or sprayed from the rapidly rotating spinning-wheels 34 as indicated by the reference numeral 38. The mineral fiber spray 38 is collected on a continuously operated first conveyer belt 42 forming a primary mineral fiber-insulating web 50. A heat-hardening bonding agent is also added to the primary mineral fiber-insulating web 50 either directly to the primary mineral fiber-insulating web 50 or at the stage of expelling the mineral fibers from the spinning-wheels 34, i.e. at the stage of forming the individual mineral fibers. The first conveyer belt 42 is, as is evident from FIG. 2, composed of two conveyer belt sections. A first conveyer belt section which is sloping relative to the horizontal direction and relative to a second substantially horizontal conveyer belt section. The first section constitutes a collector section, whereas the second section constitutes a transport section.

Figure 3A:
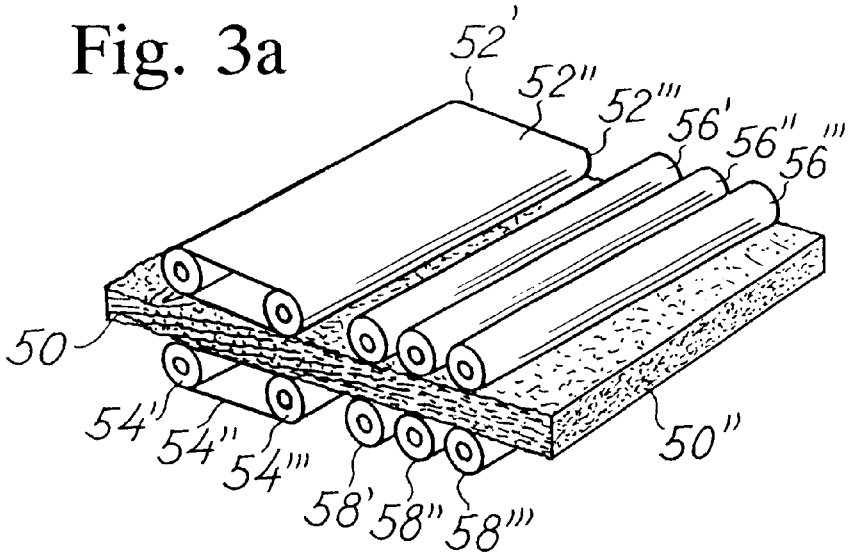
FIG. 3*a* is a schematic and perspective view illustrating a production step of height-compressing and longitudinally compressing a mineral fiber-insulating web.

In FIG. 3*a*, a station for compacting and homogenizing an input mineral fiber-insulating web 50 is shown, which station serves the purpose of compacting and homogenizing the input mineral fiber-insulating web 50 for producing an output mineral fiber-insulating web 50", which output mineral fiber-insulating web 50" is more compact and more homogeneous as compared to the input mineral fiber-insulating web 50. The input mineral fiber-insulating web 50 may constitute the primary mineral fiber-insulating web 50 produced in the station shown in FIG. 2.

The compacting station comprises two sections. The first section comprises two conveyer belts 52" and 54", which are arranged at the upper side surface and the lower side surface, respectively, of the mineral fiber web 50. The first section basically constitutes a section in which the mineral fiber web 50 Input to the section is exposed to a height compression, causing a reduction of the overall height of the mineral fiber web and a compacting of the mineral fiber web. The conveyer belts 52" and 54" are consequently arranged in a manner, in which they slope from an input end at the left-hand side of FIG. 3*a*, at which input end the mineral fiber web 50 is input to the first section, towards an output end, from which the height-compressed mineral fiber web is delivered to the second section of the compacting station.

The second section of the compacting station comprises three sets of rollers 56' and 58', 56" and 58", and 56'" and 58'". The rollers 56', 56" and 56'" are arranged at the upper side surface of the mineral fiber web, whereas the rollers 58', 58" and 58'" are arranged at the lower side surface of the mineral fiber web. The second section of the compacting station provides a longitudinal compression of the mineral fiber web, which longitudinal compression produces a homogenization of the mineral fiber web, as the mineral fibers of the mineral fiber web are caused to be rearranged as compared to the initial structure into a more homogeneous structure. The three sets of rollers 56' and 58', 56" and 58", and 56'" and 58'" of the second section are rotated at the same rotational speed, which is, however, lower than the rotational speed of the conveyer belts 52" and 54" of the first section, causing the longitudinal compression of the mineral fiber web. The height-compressed and longitudinally compressed mineral fiber web is output from the compacting station shown in FIG. 3*a*, designated the reference numeral 50".

It is to be realized that the combined height-and-longitudinal-compression compacting station shown in FIG. 3*a* may be modified by the omission of one of the two sections, i.e. the first section constituting the height-compression section, or alternatively the second section constituting the longitudinal-compression section. By the omission of one of the two sections of the compacting station shown in FIG. 3*a*, a compacting section performing a single compacting or compression operation is provided, such as a height-compressing station or alternatively a longitudinally-compressing station. Although the height-compressing section has been described including conveyer belts, and the longitudinally-compressing section has been described including rollers, both sections may be implemented by means of belts or rollers. Also, the height-compressing section may be implemented by means of rollers, and the longitudinally-compressing section may be Implemented by means of conveyer belts.

Figure 3B:
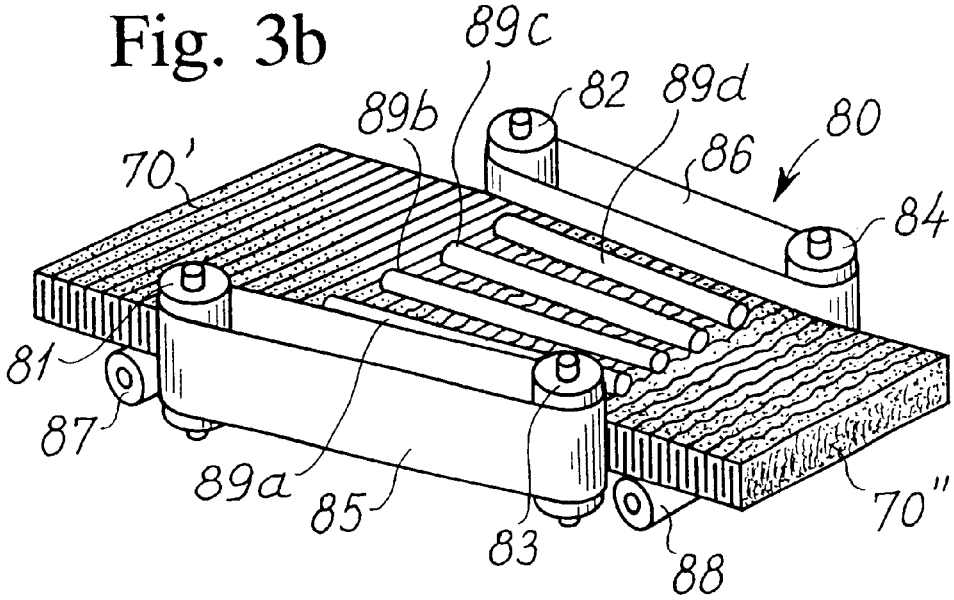
FIG. 3*b* is a schematic and perspective view illustrating a production step of transversely compacting the height compressed and longitudinally compressed mineral fiber-insulating web produced in the production step shown in FIG. 3*a,*

In FIG. 3*b*, a transversally-compressing station is shown, which is designated the reference numeral 80 in its entirety. In the station 80, an input mineral fiber-insulating web 70' produced in accordance with a technique to be described below with reference to FIG. 1 is brought into contact with two conveyer belts 85 and 86, which define a constriction in which the mineral fiber-insulating web is caused to be transversally compressed and into contact with a total of four surface-agitating rollers 89*a*, 89*b*, 89*c* and 89*d*, which together with similar rollers, not shown in the drawing, arranged opposite to the rollers 89*a*, 89*b*, 89*c* and 89*d* serve the purpose of assisting in providing a transversal compression of the entire web 70'. The conveyer belts 85 and 86 are journalled on rollers 81, 83 and 82, 84, respectively.

From the transversally-compressing station 80, a transversally compressed and compacted mineral fiber-insulating web 70" is supplied. As the mineral fiber-insulating web 70' is transmitted through the transversally-compressing station 80 and transformed into the transversally compressed mineral fiber-insulating web 70", the web is supported on rollers constituted by an input roller 87 and an output roller 88.

Provided the mineral fiber-insulating web 70' to be transversally compressed within the station 80 shown in FIG. 3*b* is provided with a top surface layer, such as a woven mesh foil 46' to be described below with reference to FIG. 1, the foil has to be of a structure compatible with he transversal compression of the web and foil assembly. Thus, the foil applied to the upper side surface of the mineral fiber-insulating web 70' has to be compressable and adaptable to the reduced width of the mineral fiber-insulating web 70" output from the transversally-compressing station 80.

Figure 3C:
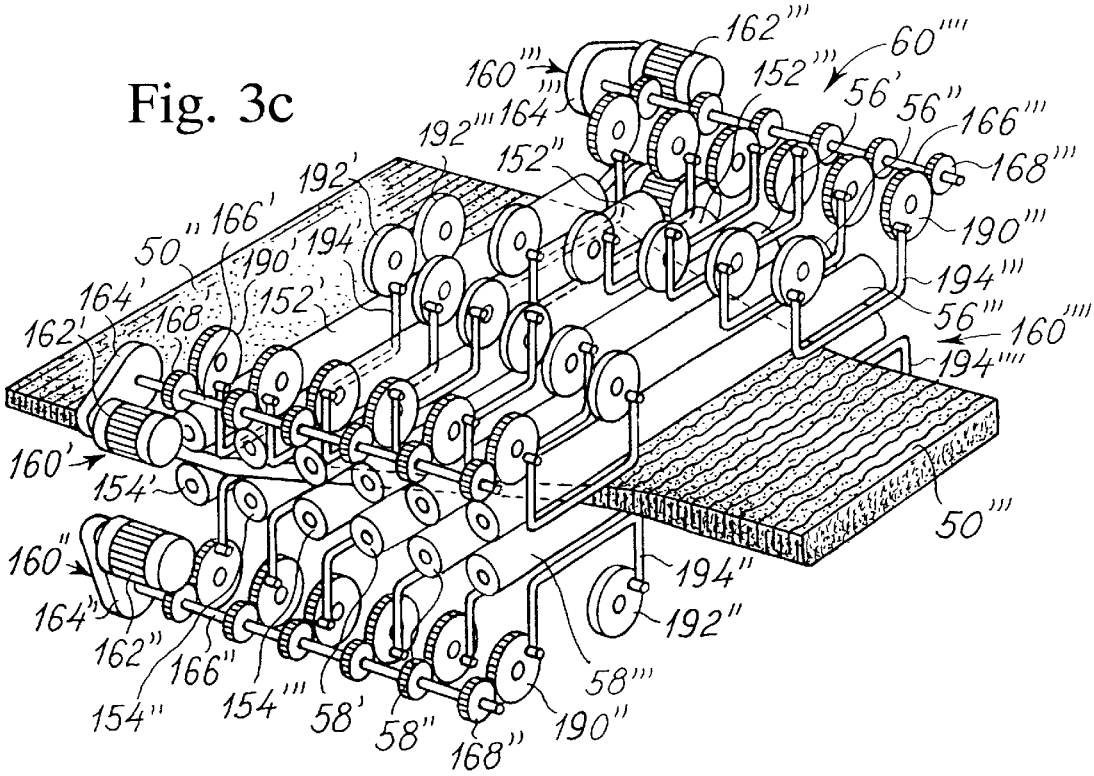
FIG. 3*c* is a schematic and perspective view illustrating a production step of simultaneously transversally compressing, height-compressing and longitudinally compressing a mineral fiber-insulating web.

In FIG. 3*c*, an alternative technique of compressing a mineral fiber-insulating web 50'" is shown. According to the technique disclosed in FIG. 3*c*, a station 60"" is employed, which station constitutes a combined height-compressing, longitudinally-compressing and transversally compressing station. Thus, the station 60"" comprises a total of six sets of rollers, three sets of which are constituted by the three sets of rollers 56', 58'; 56", 58"; and 56'", 58'" discussed above with reference to FIG. 3*a*, and constitutes an alternative to the combination of the stations discussed above with reference to FIGS. 3*a* and 3*b*.

The station 60"" shown in FIG. 3*c* further comprises three sets of rollers, a first set of which is constituted by two rollers 152' and 154', a second set of which is constituted by two rollers 152" and 154", and third set of which is constituted by two rollers 152'" and 154'". The rollers 152', 152" and 152'" are arranged at the upper side surface of the mineral fiber-insulating web 50" like the rollers 56', 56" and 56'". The three rollers 154', 154" and 154'" are arranged at the lower side surface of the mineral fiber-insulating web 50" like the rollers 58', 58" and 58'". The three sets of rollers 152', 154'; 152", 154"; and 152'", 154'" serve the same purpose as the belt assemblies 52", 54" discussed above with reference to FIG. 3*a*, viz. the purpose of height compressing the mineral fiber-insulating web 50" input to the station 60"".

The three sets of height-compressing rollers 152', 154'; 152", 154"; and 152'", 154'" are like the above-described belt assemblies 52", 54" operated at a rotational speed identical to the velocity of the mineral fiber-insulating web 50" input to the height-compressing section of the station 60"". The three sets of rollers constituting the longitudinally-compressing section, i.e. the rollers 56', 58'; 56", 58"; and 56'", 58'", are operated at a reduced rotational speed determining the longitudinal compression ratio.

For generating the transversal compression of the mineral fiber-insulating web 50" input to the station 60"", shown in FIG. 3*c*, four crankshaft assemblies designated the reference numerals 160', 160", 160'", and 160"" are provided. The crankshaft assemblies are of identical structures, and in the below description a single crankshaft assembly, the crankshaft assembly 160', is described, as the crankshaft assemblies 160', 160'" and 160"" are identical to the crankshaft assembly 160" and comprise elements identical to the elements of the crankshaft assembly 160", however, designated the same reference numerals added a single, a double and a triple mark, respectively.

The crankshaft assembly 160" includes a motor 162", which drives a gear assembly 164", from which an output shaft 166" extends. A total of six gearwheels 168" of identical configurations are mounted on the output shaft 166". Each of the gearwheels 168" meshes with a corresponding gearwheel 190". Each of the gearwheels 190" constitutes a drivewheel of a crankshaft lever system further comprising an idler wheel 192" and a crankshaft lever 194". The crankshaft levers 194" are arranged so as to be lifted from a retracted position to an elevated position between two adjacent rollers at the right-hand, lower side of the mineral fiber-insulating web 50" input to the station 60"" and are adapted to cooperate with crankshaft levers of the crankshaft lever system 160' positioned at the right-hand, upper side of the mineral fiber-insulating web 50" input to the station 60"".

Similarly, the crankshaft levers of the crankshaft lever systems 160'" and 160"", arranged at the left-hand, upper and lower side, respectively, of the mineral fiber-insulating web 50" input to the station 60"", are adapted to cooperated in a manner to be described below.

As is evident from FIG. 3*c*, a first set of crankshaft levers 194', 194", 194'", 194"" of the crankshaft lever systems 160', 160", 160'" and 160"" are positioned between the first and second sets of rollers 152', 154' and 152", 154". Similarly, a second set of crankshaft levers are positioned between the second and third sets of rollers 152", 154" and 152'", 154'".

The crankshaft levers of each of the total of six crankshaft lever sets are of identical widths. Within each of the crankshaft lever systems 160', 160", 160'" and 160"", the first crankshaft lever is the widest crankshaft lever, and the width of the crankshaft lever within each crankshaft lever system is reduced from the first crankshaft lever to the sixth crankshaft lever positioned behind the sixth set of rollers 56'", 58 '".

By means of the motors of the crankshaft assemblies 160', 160", 160'" and 160"", the crankshaft levers of a specific crankshaft set are rotated in synchronism with the remaining three crankshaft levers of the crankshaft lever set in question. The crankshaft levers of all six sets of crankshaft levers are moreover operated in synchronism and in synchronism with the velocity of the mineral fiber-insulating web 50" input to the station 60"". The widest or first set of crankshaft levers is adapted to initiate the transversal compression of the mineral fiber-insulating web 50", as the crankshaft levers 194" and 194"" of the crankshaft lever systems 160" and 160"", respectively, are raised from positions below the lower side surface of the mineral fiber-insulating web 50" and are brought into contact with the lower side surface of the mineral fiber-insulating web 50", and as the crankshaft levers 194' and 194'" of the crankshaft lever systems 160' and 160'", respectively, are simultaneously lowered from positions above the upper side surface of the mineral fiber-insulating web 50" and brought into contact with the upper side surface of the mineral fiber-insulating web 50".

Further rotation of the output shafts 166', 166", 166'" and 166"" causes the crankshaft levers of the first set of crankshaft levers to be moved towards the center of the mineral fiber-insulating web 50", providing a transversal compression of a central area of the mineral fiber-insulating web 50". As the crankshaft levers of the first set of crankshaft levers reach the central position, the crankshaft levers of the crankshaft lever systems 160" and 160"" are raised, whereas the crankshaft levers of the crankshaft lever systems 160" and 160"" are lowered and consequently brought out of contact with the upper and lower side surface, respectively, of the mineral fiber-insulating web 50".

As the mineral fiber-insulating web 50" is moved further through the station 60"", the next or second set of crankshaft levers provides an additional transversal compression of areas of the mineral fiber-insulating web 50", which areas are positioned at opposite sides of the above-mentioned central area, whereupon the third, the fourth, the fifth, and the sixth sets of crankshaft levers provide additional transversal compression of the mineral fiber-insulating web, producing an overall, homogeneous, transversal compression of the mineral fiber-insulating web.

The width of the crankshaft levers of each set of crankshaft levers, the gear ratio of the gear assemblies 164', 164", 164'" and 164"", the gear ratio of the gearwheels 168 and 190, and the velocity of the mineral fiber-insulating web 50" input to the station 60"" are adapted to one another and further to the rotational speed of the height compression and the longitudinally-compressing sections of the station for producing the height-, longitudinally-compressed and transversally-compressed mineral fiber-insulating web 50'".

The integration of the height-compressing section, the longitudinally-compressing section and the transversally compressing section into a single station, as described above with reference to FIG. 3*c*, is, by no means, mandatory to the operation of the crankshaft systems described above with reference to FIG. 3*c*. Thus, the height-compressing section, the longitudinally-compressing section and the transversally-compressing sections may be separated, however, the integration of all three functions reduces the overall size of the production plant.

The primary mineral fiber-insulating web 50 produced in the station shown in FIG. 2 and optionally compressed in accordance with the technique described above with reference to FIG. 3*a* is in accordance with the presently preferred embodiment of the method according to the present invention further processed in a production station disclosed in FIG. 1. The mineral fiber-insulating web 50 is input to the production station by means of the first conveyer belt 42. At the input of the production station, the primary mineral fiber-insulating web 50 is brought into contact with a separating tool 60 serving the purpose of separating the primary mineral fiber-insulating web 50 into two mineral fiber-insulating webs 70 and 78. The mineral fiber-insulating web 70 is a low compactness and low area weight web such as a non-compacted web of an area weight of 600–1200 g/m$^2$. The mineral fiber-insulating webs 70 and 78 are conveyed from the separating tool 60 by means of a conveyer belt 62' and two conveyer belts 62" and 62'", respectively.

In the plant shown in FIG. 1, the web 78 to be further processed as described below is separated from the lower part of the primary mineral fiber-insulating web 50, as the upper part of the primary mineral fiber-insulating web contains the smaller mineral fiber components, as the larger and heavier mineral fiber components are collected at the lower part of the primary mineral fiber-insulating web 50 collected on the first conveyer belt 42, as shown in FIG. 1. From the upper part of the primary mineral fiber-insulating web 50, which part is constituted by the web 70, a more homogeneous insulating product may be manufactured as compared to a similar product made from the lower part of the primary mineral fiber-insulating web 50, which part is constituted by the web 78.

The mineral fiber-insulating web 70 is transferred from the conveyer belt 62' to two appositely arranged conveyer belts 64' and 64" which serve the purpose of sandwiching the mineral fiber-insulating web 70 between opposite surfaces of the conveyer belts for guiding the web as the web is lowered from an elevated position to a lower position without any risk of breaking and collapsing of the low compactness and low area weight mineral fiber-insulating web 70. From the sandwiching conveyer belts 64' and 64", the web 70 is further conveyed by means of two conveyer belts 64'" and 64"" to a second set of substantially horizontal conveyer belts from which the web 70 is introduced into three sets of sandwiching conveyer belts, of which two conveyer belts 66' and 66" constitute a first set, of which two conveyer belts 68' and 68" constitute a second set, and of which two conveyer belts 72' and 72" constitute a third set. The rate of transportation of the conveyer belts of the three sets of conveyer belts diminishes from the first set to the third set generating a deceleration of the rate of transportation of the mineral fiber-insulating web 70 causing an accumulation of mineral fiber-web material within the third set of conveyers belts 72' and 72" resulting in that the web 70 is folded transversely relative to the longitudinal direction and the direction of transportation of the mineral fiber-insulating web 70.

The conveyer belts 68' and 68" constituting the second set, and the conveyer belts 72' and 72" constituting the third set, each constitutes conveyer-belt sets in which the conveyer belts are mutually parallel, and which sets are further aligned relative to one another, as the conveyer belts 68' and 72', and similarly the conveyer belts 68" and 72", are aligned relative to one another. Alternatively, the second set comprising the conveyer belts 68' and 68" may taper from the input end towards the output end of the second set, whereas the third set comprising the conveyer belts 72' and 72" may taper from the output end towards the input end of the third set. Consequently, a constriction may be provided at the transition from the second set to the third set. Further alternatively, the distance between the conveyer belts 72' and 72" of the third set may at the input end of the third set be smaller than or larger than the distance between the conveyer belts 68' and 68" of the second set at the output end of the second set, irrespective of whether or not the second and/or the third set are tapering towards the transition between the second and the third set. Still further alternatively, the conveyer belts 72' and 72" of the third set may be operated at different velocities, providing a specific surface treatment at the upper or lower side surface of the mineral fiber-insulating web sandwiched between the conveyer belts 72' and 72".

The low compactness and low area weight mineral fiber-insulating web 70 is folded into a mineral fiber web 70' in which segments of the mineral fiber web 70 are positioned perpendicular to the longitudinal and transversal directions of the web 70'. It is to be realized that the overall orientation of the mineral fibers of the web 70 originating from the primary mineral fiber-insulating web 50 is along the longitudinal direction of the web. Consequently, the overall orientation of the mineral fibers of the folded mineral fiber-insulating web 70' is perpendicular to the longitudinal and transversal directions of the web 70'.

It is further to be realized that, due to the low area weight and low compactness of the mineral fiber-insulating web 70, which is folded as discussed above, the web 70 is to a great extent broken into individual segments which are arranged perpendicular to the longitudinal and transversal directions of the web 70'. As the web 70 is broken into individual segments, the individual segments of the folded mineral fiber-insulating web 70' basically contain mineral fibers orientated perpendicular to the longitudinal and transversal directions of the web 70'. In case the web 70 is not broken into individual segments, the web 70' contains transition segments interconnecting adjacent segments of the web 70', which last-mentioned segments constitute the above-described segments containing mineral fibers orientated perpendicular to the longitudinal and transversal directions of the web 70'. The mineral fibers contained within the transition segments are, contrary to the overall orientation of the mineral fibers of the folded mineral fiber-insulating web 70', orientated in the very same orientation as the mineral fibers of the mineral fiber-insulating web 70, i.e. in the longitudinal direction of the webs 70 and 70'.

From the third set of conveyer belts 72' and 72" providing the folding of the mineral fiber-insulating web 70 and producing the folded mineral fiber-insulating web 70', the folded mineral fiber-insulating web 70' is input to the transversally compressing station 80, discussed above with reference to FIG. 3*b*, or alternatively input to a station similar to the station 60"", discussed above with reference to FIG. 3*c*. The folded mineral fiber-insulating web 70' may prior to or after the transversal compression performed in the station 80 or 60"" be exposed to additional compression such as height and/or longitudinal compression in the station similar to the station discussed above with reference to FIG. 3*a* or in the station 60"" discussed above with reference to FIG. 3*c*.

In FIG. 1, a roll 44' is shown in dotted line, from which roll a foil 46' of e.g. a thermoplastics material or a woven or a non-woven mesh material is pressed against the upper side surface of the mineral fiber-insulating web 70 by means of a foller 48'. Alternatively, an additional foil may be applied to the lower side surface of the mineral fiber-insulating web 70 prior to the folding of the mineral fiber-insulating web 70 by means of the three sets of conveyer belts 66', 66"; 68', 68" and 72', 72'. Further alternatively, an additional or alternative foil 46" may be applied to the upper side surface of the folded and transversally and optionally height- and/or longitudinally compressed mineral fiber-insulating web 70' by means of a roller 48" of an upper conveyer belt 74 to be further described below. The foil 46" is supplied from a roll 44". Still further alternatively, an additional or alternative foil may be supplied to the lower side surface of the mineral fiber-insulating web 70' and sandwiched between the lower side surface of the web 70' and a surface layer produced from the mineral fiber-insulating web 78 separated from the primary mineral fiber-insulating web 50, as will be described below.

The mineral fiber-insulating web 78 separated from the primary mineral fiber-insulating web 50 is transferred from the conveyer belt 62'" to a station designated the reference numeral 90 in its entirety from which station an output web 78' is supplied. The output web 78' differs from the input web 78 in that the overall orientation of the mineral fibers of the output web 78' is shifted from the overall longitudinal direction of the mineral fibers of the input web 78 to an overall orientation transversely relative to the longitudinal direction of the output web 78'. Furthermore, the station 90 provides a more homogeneous and compact output web 78' as compared to the input web 78. The shift of the orientation of the mineral fibers and the compacting and homogenization of the mineral fiber-insulating web is accomplished in the station 90 by arranging the mineral fiber-insulating web 78' in transversely overlapping relation as the assembly 90 comprises oppositely arranged conveyer belts one of which is shown in FIG. 1 and designated the reference numeral 104, which conveyer belts sandwich the input mineral fiber-insulating web 78 between oppositely arranged surfaces of the conveyer belts and are swung across a sloping pick-up conveyer belt 106. The station 90 also includes an input roller 100 and a set of rollers 102 serving the purpose of supplying the input mineral fiber-insulating web 78 to the swingable and sandwiching conveyer belts one of which is designated the reference numeral 104.

From the sloping pick-up conveyer belt 106, the output mineral fiber-insulating web 78' is transferred to a further conveyer belt 108 an input to a compacting station comprising a conveyer belt 118" which acts on the upper side surface of the output mineral fiber-insulating web 78' for generating a compacting and height-compressing effect. The compacting station also includes a pressing roller acting on the upper side surface of the partly compacted mineral fiber-insulating web. From the conveyer belt 118" and the pressing roller 118', the partly compacted mineral fiber-insulating web is input to two sets of conveyer belts sandwiching the web, a first set of which comprises two conveyer belts 110' and 110" arranged at the upper and lower side surface of the web, respectively, and of which a second set comprises two conveyer belts 112' and 112" arranged at the upper and lower side surface, respectively, of the web. From the two sets of conveyer belts, the mineral fiber-insulated web is input to a further compacting station comprising six sets of rollers, a first set of which is designated the reference numerals 114' and 114".

The two sets of conveyer belts and the six sets of rollers are operated at different rates causing a deceleration of the mineral fiber-insulating web and further a compacting of the web. The two sets of conveyer belts 110', 110" and 112', 112" together constitute a longitudinally-pressing station similar to the station described above with reference to FIG. 3*a*, whereas the station comprising the six sets of rollers may constitute a height- and/or longitudinally compressing station, i.e. an optional and additional compressing station as compared to the longitudinally compressing station including the two sets of conveyer belts 110', 110" and 112', 112". It is to be realized that the folding of the input mineral fiber-insulating web 78 and the compacting of the output mineral fiber-insulating web 78' has to comply with the rate of reduction of the transportation of the low compactness and low area weight mineral fiber-insulating web 70 caused by folding the web within the above described three sets of conveyer belts producing the transversely folded mineral fiber-insulating web 70'. 5 The compacted mineral fiber-insulating web output from the compacting stations comprising two sets of conveyer belts 110', 110" and 112', 112" and the rollers 114' and 114" is designated the reference numeral 78". The density of the mineral fiber-insulating web 78" is of the order of 180–210 kg/m$^3$ as compared to the density of the input mineral fiber-insulating 78 being of the order of 80–140 kg/m$^3$. Thus, a factor of compression or compactness in the order of 1:2–1:5 is accomplished. The mineral fiber-insulating web 78" is further conveyed on a conveyer belt 116 to a conveyer belt station comprising the upper conveyer belt 74 and a lower conveyer belt 76, which conveyer belt station serves the purpose of adjoining the compacted mineral fiber-insulating web 78' in facial contact with the folded and transversally and optionally height- and/or longitudinally compressed mineral fiber-insulating web 70'. The composite mineral fiber-insulating web produced by adjoining the webs 78" and in facial contact with one another is designated the reference numeral 50'". Apart from the central web 70' and the compacted surface layer 78" arranged at one side of the mineral web 70', the composite mineral fiber-insulating web assembly 50'" further preferably comprises an additional compacted surface layer similar to the layer 78', however, arranged at the opposite side surface of the folded mineral fiber-insulating web 70' sandwiching the web 70' between the additional compacted surface layer and the compacted surface layer 78". The composite mineral fiber-insulating web assembly 50'" is further processed as will be described below with reference to FIG. 4. Prior to further processing the mineral fiber-insulating web assembly 50'", the assembly is optionally exposed to a composite compacting and compression in a station similar to the station discussed above with reference to FIG. 3*a*–3*c*.

Prior to the processing of the mineral fiber-insulating web assembly 50'", an additional foil may optionally be applied to the lower side surface of the compacted surface layer 78" as discussed above. The foil applied to the lower side surface of the compacted surface layer 78" may constitute a foil of a plastics material or of alternative materials to be described below with reference to FIG. 5*b*.

Figure 4:
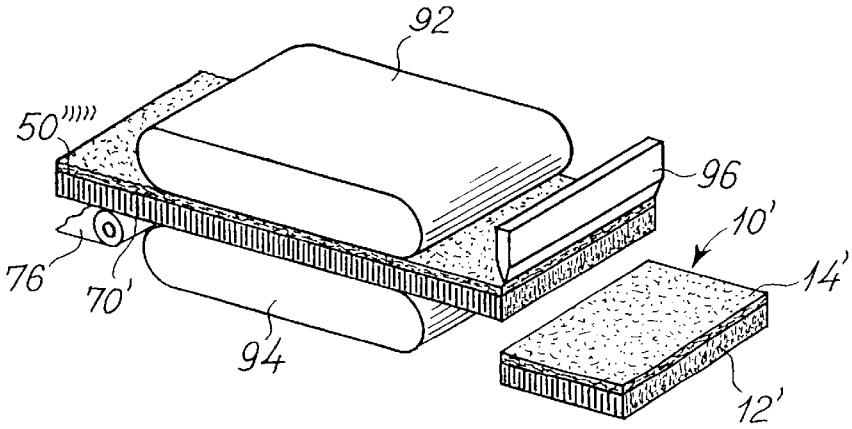
FIG. 4 is a schematic and perspective view illustrating a production step of curing a mineral fiber-insulating web and a production step of separating the cured mineral fiber-insulating web into plate segments.
Figure 8:
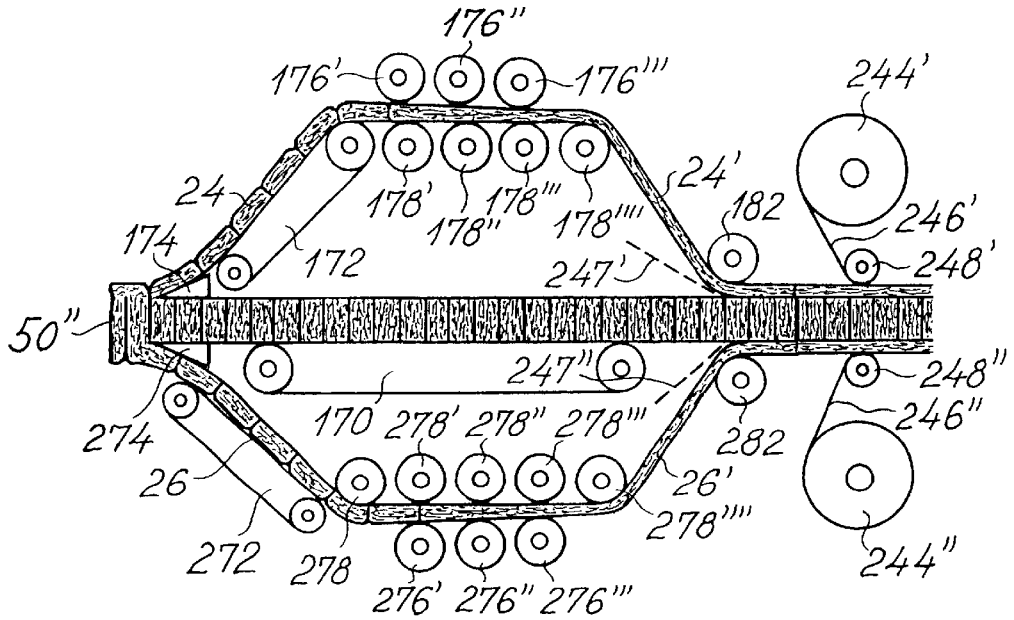
FIG. 8 is a schematic and perspective view illustrating a production step of separating surface layers of the folded mineral fiber-insulating web produced in accordance with the technique disclosed in FIG. 5, a production step of compacting the surface layer, and a production step of adjoining the compacted surface layers to the remaining part of the central core of the mineral fiber-insulating web produced in accordance with the technique disclosed in FIG. 7.

In FIG. 4, the mineral fiber-insulating web assembly 50'"", which may constitute the mineral fiber-insulating web 50'" shown in FIG. 1 or the mineral fiber-insulating web assembly 50"" shown in FIG. 8, moreover Including a single compacted surface layer, is moved through a curing station constituting a curing oven or curing furnace comprising oppositely arranged curing oven section 92 and 94, which generate heat for heating the mineral fiber-insulating web assembly 50'"" to an elevated temperature so as to cause the heat-curable bonding agent of the mineral fiber-insulating web assembly to harden and cause the mineral fibers of the central core or the body of the assembly and the mineral fibers of the compacted surface layer or surface layers to be bonded together so as to form an integral bonded mineral fiber-insulating web which is cut into plate-like segments by means of a knife 96. In FIG. 4, a single plate-like segment 10' is shown comprising a central core 12' and a top layer 14'.

In FIG. 5*a*, a fragmentary and perspective view of a first embodiment of a mineral fiber-insulating plate assembly 10 is shown, produced from the mineral fiber-insulating web assembly 50'" shown in FIG. 1. The mineral fiber-insulating plate assembly 10 comprises a central core or body 12 produced from the folded mineral fiber-insulating web 70' and a surface layer 14 produced from the compacted surface layer 78'. The reference numeral 16 designates a single segment of the central core or body 12, which segment constitutes a single folding of the low compactness and low area weight mineral fiber-insulating web 70, and which is in most cases separated from the adjacent segments as the mineral fiber-insulating web 70 is broken into separate segments as the web is folded as described above with reference to FIG. 1. Due to the low compactness and low area weight of the mineral fiber-insulating web 70, the individual segments of the central core or body 12 are very thin as compared to the overall dimensions of the mineral fiber-insulating plate segment 10 providing a central core or body 12 in which the mineral fibers to a high degree are orientated in the intentional direction perpendicular to the longitudinal and transversal directions of the plate segment 10 and consequently perpendicular to the surface layer 14.

In FIG. 5*b*, a fragmentary and perspective view of a second embodiment of the plate assembly 10 is shown. Like the first embodiment described above with reference to FIG. 5*a*, the second embodiment comprises the central core 12, the top layer 14 and the bottom layer 16. Moreover, a top surface covering 18 is provided, which may constitute a web of a plastics material, a woven or non-woven plastic foil, or alternatively a covering made from a non-plastics material, such as a paper material serving design and architectural purposes exclusively. The top surface layer 18 may alternatively be applied to the mineral fiber-insulating web after the curing of the heat-hardening, bonding agent, i.e. after the exposure of the mineral fiber-insulating web 90 to heat generated by the oven sections 92 and 94 shown in FIG. 4.

In FIG. 6, a further processing station is shown in which the mineral fiber web 70' also shown in FIG. 3*b* is transferred along a conveyor belt 353 to a separation station in which a separating assembly 354 comprising a movable cutting belt 356 divides the mineral fiber web into two separate mineral fiber webs or parts designated the reference numerals 358 and 360. The part 360 is moved through two sets of sandwiching conveyor belts comprising a first set 362 and 364 and a second set 366 and 368 to a collector conveyor belt 370. The first and second sets of conveyor belts 362, 364 and 366, 368, respectively, may produce a compacting and homogenization of the mineral fiber web 360 as described above. The mineral fiber web 358 is also input to two sandwiching conveyor belts 372 and 374 and further into a compacting and homogenizing station 376 similar to the station described above with reference to FIG. 3*a* for producing a compacted mineral fiber web 378 which is transferred from the compacting station 376 to the mineral fiber web transferred along the conveyor belt 370 by means of a further conveyor belt 380. By means of the conveyor belt 380, the compacted and homogenized mineral fiber web 378 is positioned on top of the mineral fiber web originating from the mineral fiber web 360 and optionally partly compacted and homogenized as stated above producing a composite mineral fiber web 382 comprising of a high compacted top layer and a somewhat less compacted bottom layer. The top and bottom layers may be adhered to one another by means of heat curable or curable bonding agents originally present in the mineral fiber web 50 or alternatively by means of a heat curable or curable bonding agent constituting an adhesive which is applied to the top and/or bottom layers prior to the step of contacting the top and bottom layers with one another together defining the composite mineral fiber web 382. In FIG. 6, the separating assembly 354 may be shifted from the position shown in FIG. 6 towards the conveyor belt 362 by means of a drive motor not shown in the drawings in order to alter the thickness of the mineral fiber web 358 as compared to the thickness of the mineral fiber web 360. In its extreme position, the separating assembly is prevented from separating the mineral fiber web 70 into the mineral fiber webs 358 and 360 as the mineral fiber web 70' is in its entirety forced into contact with the sandwiching conveyor belts 362 and 364.

Figure 7:
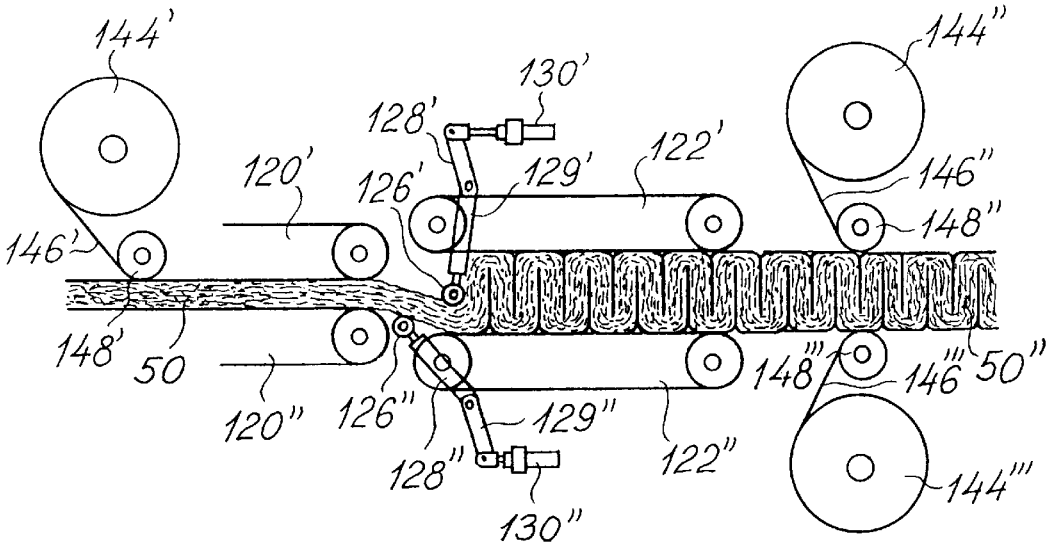
FIG. 7 is a-schematic view illustrating an alternative technique of folding a mineral fiber-insulating web transversally relative to the longitudinal direction of the mineral fiber-insulating web.

In FIG. 7, an alternative technique of folding a mineral fiber-insulating web in the transversal direction of the mineral fiber-insulating web is disclosed. In FIG. 7, the mineral fiber-insulating web 50 may constitute the output mineral fiber-insulating web 50" shown in FIG. 3*a*, or alternatively the mineral fiber-insulating web 50 produced in the station shown in FIG. 2. The mineral fiber-insulating web 50 is folded transversally as the mineral fiber-insulating web 50 is output from two sandwiching conveyer belts 120' and 120" and folded by means of intermittently operated actuator arms 126' and 126" which are intermittently brought into contact with the upper side surface and lower side surface, respectively, of the web 50. As one of the actuator arms 126' and 126" maintains the folded mineral fiber-insulating web in position within two sandwiching conveyer belts 122' and 122", the other actuator arm is brought into contact with the respective side surface of the web 50 and folds the web 50 transversally relative to the longitudinal direction of the web 50. The actuator arms 126' and 126" are supported on articulate arms 128', 129' and 128", 129", respectively, which articulate arms 128', 129' and 128", 129" are actuated by means of actuator cylinders 130' and 130', respectively. The transversally folded mineral fiber-insulating web produced by means of the production station shown in FIG. 3 and output from the sandwiching conveyer belts 122' and 122" is designated the reference numeral 50".

In FIG. 7, a roll 144' is further shown, from which a foil 146' is applied to the upper side surface of the web 50 by means of a roller 148' prior to the folding of the web 50, as discussed above. Two additional rolls 144" and 144'" are provided for supplying foils 146" and 146'", respectively, to the upper and lower side surfaces, respectively, of the transversally folded mineral fiber-insulating web 50". The foils 146" and 146'" are pressed against the upper and the lower side surfaces, respectively, of the transversally folded web 50" by means of rollers 148" and 148'", respectively. It is to be realized that the foils 146', 146" and 146'" are optional features which may be omitted as, in accordance with the preferred embodiment of the technique of transversally folding the mineral fiber-insulating web 50, the transversally folded mineral fiber-insulating web 50" is made without any additional material except for the mineral fibers and the heat-curable bonding agent.

Figure 9:
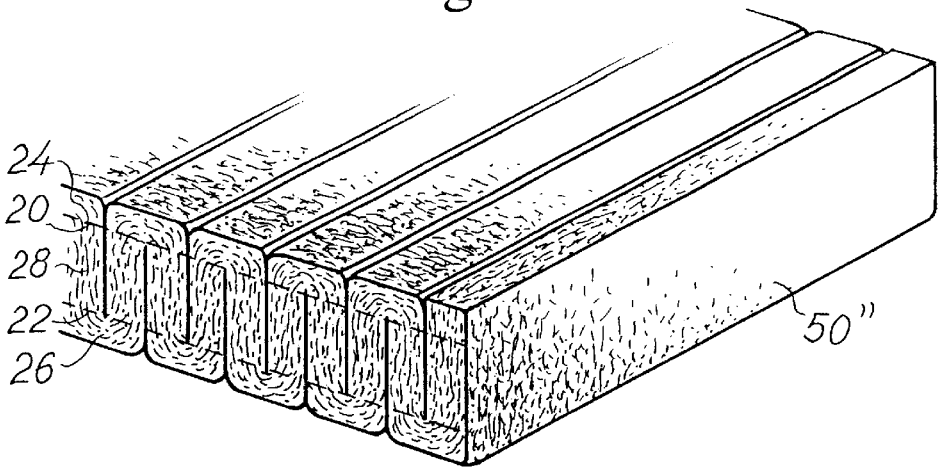
FIG. 9 is a schematic, sectional and perspective view illustrating the folded mineral fiber-insulating web produced in accordance with the techniques disclosed in FIG. 7.

In FIG. 9, a vertical sectional view of the corrugated and transversally folded mineral fiber-insulated web 50" is shown. The corrugated and transversally folded mineral fiber-insulating web 50" comprises a central core or body 28 and two oppositely arranged surface layers 24 and 26, which surface layers 24 and 26 are separated from the central core or body 28 of the corrugated and transversally folded mineral fiber-insulating web 50" along imaginary lines of separation 20 and 22, respectively. The surface layers 24 and 26 of the corrugated and transversally folded mineral fiber-insulating web 50" are composed of segments of the folded mineral fiber-insulating web which segments contain mineral fibers which are orientated substantially longitudinally relative to the longitudinal direction of the corrugated and transversally folded mineral fiber-insulating web 50". The corrugated and transversally folded mineral fiber-insulating web 50" is produced from the primary mineral fiber-insulating web 50 shown in FIG. 2 as discussed above with reference to FIG. 5, optionally after compacting the primary mineral fiber-insulating web 50 as discussd above with reference to FIG. 3, i.e. produced from the compacted mineral fiber-insulating web 50'" shown in FIG. 3, and the overall orientation of the mineral fibers of the primary mineral fiber-insulating web 50 is consequently maintained within the segments of the corrugated and transversally folded mineral fiber-insulating web 50" which segments together constitute the surface layers 24 and 26.

The central core or body 28 of the corrugated and transversally folded mineral fiber-insulating web 50" is composed of segments of the folded mineral fiber-insulating web 50" which segments are folded perpendicular to the segments of the surface layers 24 and 26 of the mineral fiber-insulating web 50". The mineral fibers of the central core of body 28 of the corrugated and transversally folded mineral fiber-insulating web 50" are consequently orientated substantially perpendicular to the longitudinal direction as well as the transversal direction of the corrugated and longitudinally folded mineral fiber-insulating web 50".

The corrugated and transversally folded mineral fiber-insulating web 50" shown in FIG. 9 and produced in accordance with the technique discussed above with reference to FIG. 7 is further processed in a station illustrated in FIG. 8, in which station the surface layers 24 and 26 are separated from the upper surface and the lower surface, respectively, of the central core or body 28 of the corrugated and transversally folded mineral fiber-insulating web 50" along the imaginary lines of separation 20 and 22, respectively, shown in FIG. 9, The separation of the surface layers 24 and 26 from the remaining part of the mineral fiber-insulating web is accomplished by means of cutting tools 174 and 274, respectively, as the remaining part of the mineral fiber-insulating web is supported and transported by means of a conveyer belt 170. The cutting tools 174 and 274 may be constituted by stationary cutting tools or knives or alternatively be constituted by transversely reciprocating cutting tools. The surface layers 24 and 26 separated from the mineral fiber-insulating web is derived from the path of travel of the remaining part of the mineral fiber-insulating web by means of conveyer belts 172 and 272, respectively, and are transferred from the conveyer belts 172 and 272, respectively, to respective sets of rollers each comprising a first set of rollers 176', 178' and 276', 278', respectively, a second set of rollers 176", 178" and 276", 278", respectively, and a third set of rollers 176'", 178'" and 276'", 278'", respectively, As is evident from FIG. 8, the surface layer 26 is passed from the belt 272 round a turning roller 278 before the surface layer 26 is brought into contact with the three sets of rollers 276' and 278', 276" and 278", and 276'" and 278'". Each of the three sets of rollers preferably together constitute a compacting section similar to the second section of the station described above with reference to FIG. 3*a* comprising the three sets of rollers 56' and 58', 56" and 58", and 56'" and 58'". By means of the above described sets of rollers, the surface layers 24 and 26 are as is evident from FIG. 8 converted through compacting into compacted surface layers 24' and 26', respectively. Thereupon, the compacted surface layers 24 and 26 are returned to the remaining part of the mineral fiber-insulating web comprising the central core or body 28 shown in FIG. 9, and adjoined in facial contact with the upper and lower surfaces, respectively, of the central core or body 28. In FIG. 8, a first set of rollers comprising a roller 178"" and a roller 182 arranged at the upper and lower side surface of the compacted surface layer 24', respectively, constituting a turning roller and a pressing roller, respectively. The roller 182 serves the purpose of pressing the compacted surface layer 24' into facial contact with the upper side surface of the central core or body 28, which is supported and transported by means of the conveyer belt 70 also shown in FIG. 8. A second set of rollers comprising a roller 278"" and a roller 282 similar to the rollers 178"" and 182, respectively, serve the purpose of guiding and pressing repeatedly the compacted surface layer 26' into facial contact with the lower side surface of the central core or body 28. After the compacted surface layers 24' and 26' have been arranged in facial contact with the upper side surface and the lower side surface of the central core or body 28, a mineral fiber-insulating web assembly is provided, which assembly is designated the reference numeral 50"" in its entirety. The assembly 50"" comprises the central low compactness, central core or body 28 and the higher compactness surface layers 24' and 26', respectively.

In FIG. 8, the reference numeral 247' and 247" designate optional foils, which are interspaced between the upper and lower compacted surface layers 24' and 26', respectively, and the central core or body 28. Two sets of rolls 244' and 244" are also shown in FIG. 8, which rolls constitute rolls similar to the rolls 144" and 144'" shown in FIG. 7. From the rolls 244' and 244", respective foils 246' and 246" are applied to the upper and lower side surfaces, respectively, of the assembly 50"" and pressed against the upper and lower side surfaces, respectively, by means of pressing rollers 248' and 248", respectively.

Figure 10:
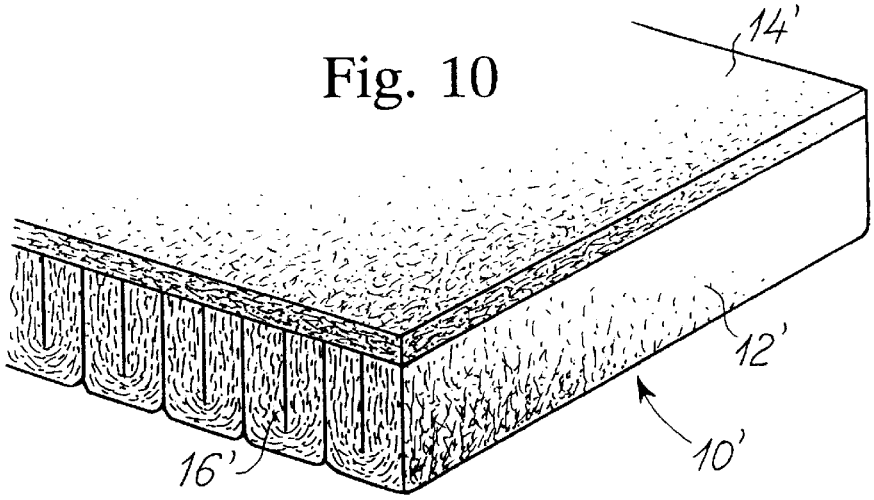
FIG. 10 is a schematic and perspective view illustrating a mineral fiber-insulating plate segment produced in accordance with the technique disclosed in FIGS. 7 and 8 and produced from the folded mineral fiber-insulating web shown in FIG. 9.

In FIG. 10, a fragmentary and perspective view of the plate segment 10' is shown. The plate segment 10' comprises the central core 12' and the top layer 14'. The reference numeral 16' designates a segment of the core 12' of the plate segment 10' which segment 16' is made from one of the segments of the central core or body 28 of the corrugated and transversally folded mineral fiber-insulating web 50" shown in FIG. 5.

Figure 11:
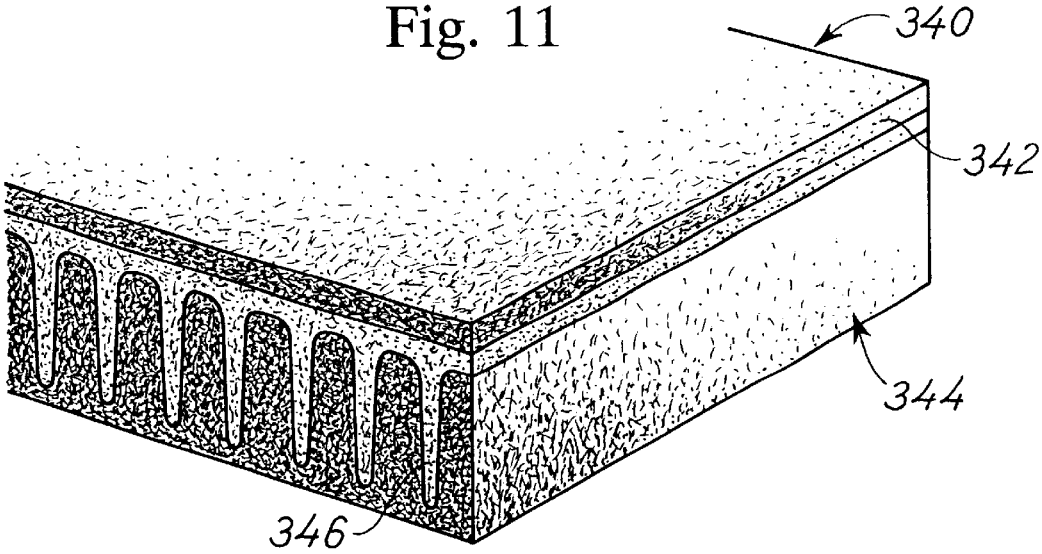
FIG. 11 is a schematic, sectional and perspective view of a further embodiment of a mineral fiber plate segment produced in accordance with the teachings of the present invention.

In FIG. 11, a further embodiment of a mineral fiber plate segment is shown designated the reference numeral 340 in its entirety. The segment 340 is composed of a central core or body 344 and a top layer 342. The top layer 342 is basically of a structure similar to the structure of the top layer 14' shown in FIG. 10 of the composite mineral fiber plate 10' shown in FIG. 10. The central core 344 of the mineral fiber plate segment 340 is produced from the composite mineral fiber web 382 described above with reference to FIG. 6 and includes a central filling out designated the reference numeral 376 which is a high compactness central filling out produced from the compacted and homogenized mineral fiber web 378 of the composite mineral fiber web 382. The part 376 may alternatively be produced from a different basic web including mineral fibers arranged or positioned in any appropriate orientation and of any appropriate compactness higher or lower than the compactness of the remaining part of the central core or body 344 which remaining part is produced from the web 360 in accordance with the teachings of the present invention.

EXAMPLE 1

A heat-insulating plate, made from a mineral fiber-insulating web produced in accordance with the method according to the present invention as described above with reference to FIGS. 1–4, is produced in accordance with the specifications listed below:

The method comprises steps similar to the steps described above with reference to FIGS. 1, 2, 3*c* and FIG. 4. The production output of the plant is 5000 kg/h. The width of the primary web produced in the station disclosed in FIG. 2 is 3600 mm. The area weight of the low compactness and low area weight web produced in the station disclosed in FIG. 1 is 0.4 kg/m$^2$. The rate of longitudinal compression produced in the station disclosed in FIG. 3*c* is 1:2, and the rate of transversal compression produced in the station disclosed in FIG. 3*c* is 1:2. The density of the central core or body of the final plate disclosed in FIG. 5*b* is 20 kg/m$^3$. The final plate includes a single surface layer of a thickness of 10 mm and of a density of 100 kg/m$^3$. The rate of longitudinal compression of the surface layer is 1:3 and the area weight of the surface layer is 1 kg/m$^2$. The width of the mineral fiber-insulating web produced in FIG. 1 is 1800 mm.

The production parameters used are listed in tables A and B below:

TABLE A

| Total thickness mm | A rpm/min × 10 | B m/min | C m/min | D m/min | E m/min | F m/min |
|---|---|---|---|---|---|---|
| 50 | 64.30 | 51.44 | 77.16 | 25.72 | 51.44 | 25.72 |
| 75 | 50.32 | 65.42 | 60.39 | 20.13 | 40.26 | 20.13 |
| 100 | 41.34 | 74.40 | 49.60 | 16.53 | 33.07 | 16.53 |
| 125 | 35.07 | 80.67 | 42.09 | 14.03 | 28.06 | 14.03 |
| 150 | 30.46 | 85.28 | 36.55 | 12.18 | 24.37 | 12.18 |
| 175 | 26.92 | 88.82 | 32.30 | 10.77 | 21.53 | 10.77 |
| 200 | 24.11 | 91.63 | 28.94 | 9.65 | 19.29 | 9.65 |
| 225 | 21.84 | 93.90 | 26.21 | 8.74 | 17.47 | 8.74 |
| 250 | 19.96 | 95.79 | 23.95 | 7.98 | 15.96 | 7.98 |
| 275 | 18.37 | 97.37 | 22.05 | 7.35 | 14.70 | 7.35 |

A = Number of strokes of pendulum 104
B = Velocity of belts 42, 62", 62'", 100, 102, 104, 62, 64', 64", 64'", 66' and 66"
C = Velocity of belts 106, 108, 118", 110' and 110"
D = Velocity of belts 112', 112", 114', 114", 116, 78' and 76
E = Velocity of belts 68' and 68"
F = Velocity of belts 72', 72" and 74"

TABLE B

| Total thickness mm | G kg/m$^2$ | H kg/m$^2$ | I kg/m$^2$ | J kg/m$^2$ | K kg/m$^3$ × 10 | L Specific |
|---|---|---|---|---|---|---|
| 50 | 0.90 | 0.80 | 0.50 | 0.40 | 3.60 | 0.80 |
| 75 | 0.71 | 1.30 | 0.31 | 0.40 | 3.07 | 1.30 |
| 100 | 0.62 | 1.80 | 0.22 | 0.40 | 2.80 | 1.80 |
| 125 | 0.57 | 2.30 | 0.17 | 0.40 | 2.64 | 2.30 |
| 150 | 0.54 | 2.80 | 0.14 | 0.40 | 2.53 | 2.80 |
| 175 | 0.52 | 3.30 | 0.12 | 0.40 | 2.46 | 3.30 |
| 200 | 0.51 | 3.80 | 0.11 | 0.40 | 2.40 | 3.80 |
| 225 | 0.49 | 4.30 | 0.09 | 0.40 | 2.36 | 4.30 |
| 250 | 0.48 | 4.80 | 0.08 | 0.40 | 2.32 | 4.80 |
| 275 | 0.48 | 5.30 | 0.08 | 0.40 | 2.29 | 5.30 |

Figure 12:
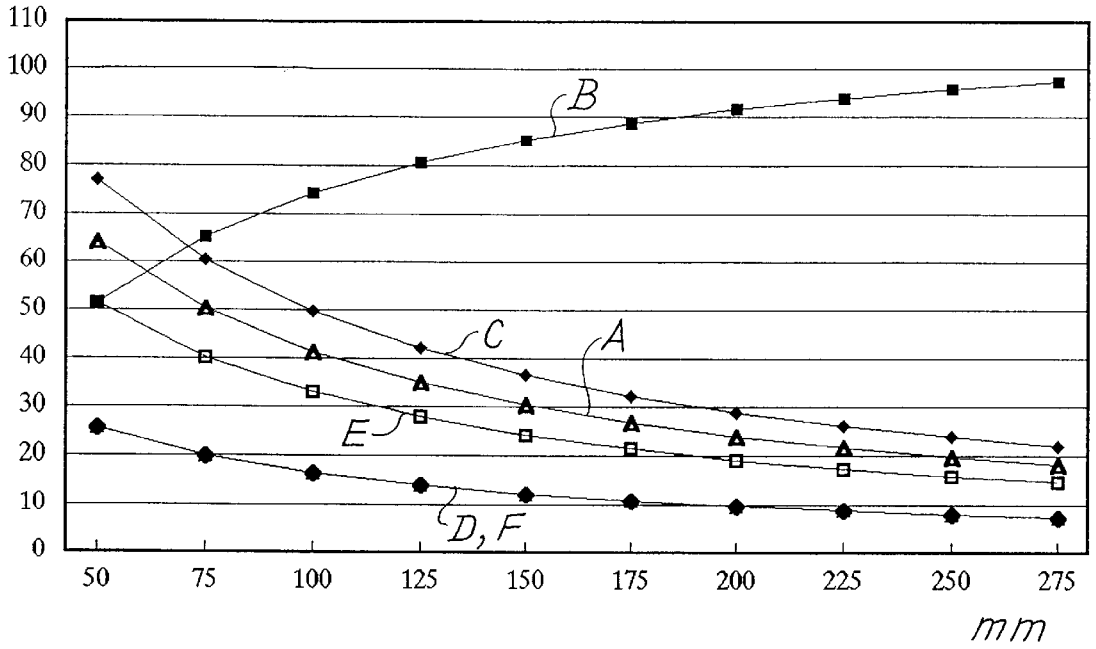
FIGS. 12 and 13 are diagrammatic views illustrating production parameters of an online production plant producing general building-insulating plates from a mineral fiber-insulating web produced in accordance with the teachings of the present invention.

G = Area weight of primary mineral fiber-insulating web on belt 42
H = Area weight of central core or body after folding
I = Area weight of surface layer
J = Area weight of central core or body before transversal folding
K = Average density
L = Ratio between central core or body and surface layer In FIG. 12, a diagramme is shown, illustrating the correspondence between the parameters listed in Table A. The reference signs used In FIG. 12 refer to the parameters listed in Table A.

Figure 13:
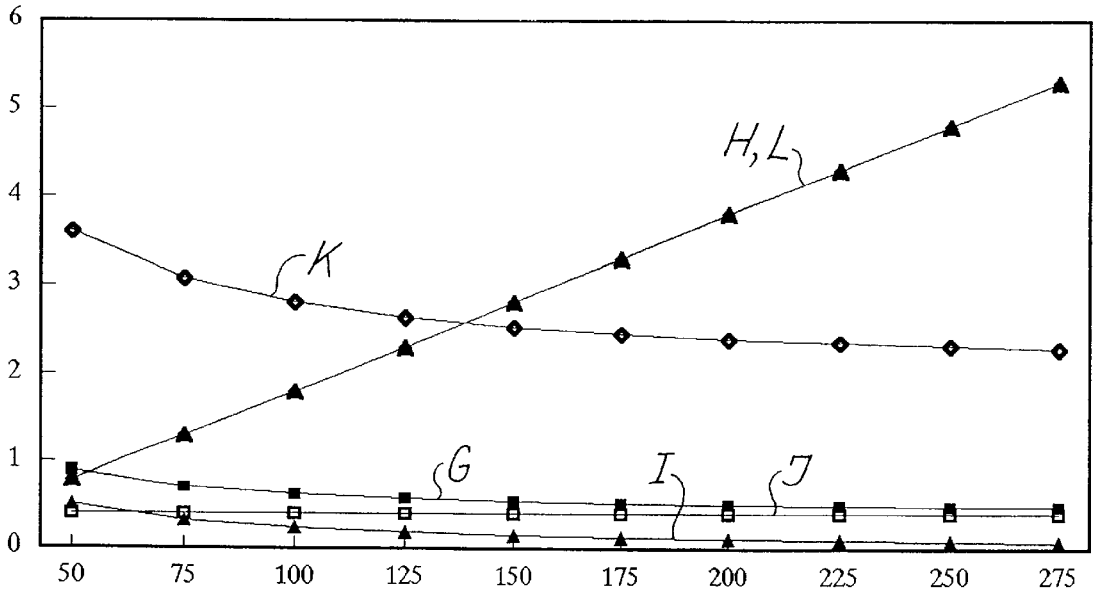

In FIG. 13, a diagramme is shown, illustrating the correspondence between the parameters listed in Table B. The reference signs used in FIG. 13 refer to the parameters listed in Table B.

EXAMPLE 2

Composite roofing plate made from a mineral fiber-insulating web produced in accordance with the method according to the present invention as described above with reference to FIGS. 1–4, is produced in accordance with the specifications listed below:

The method comprises steps similar to the steps described above with reference to FIGS. 1, 2, 3*c* and FIG. 4. The production output of the plant is 5000 kg/h. The width of the primary web produced in the station disclosed in FIG. 2 is 3600 mm. The area weight of the low compactness and low area weight web produced in the station disclosed in FIG. 1 is 0.6 kg/m$^2$. The rate of longitudinal compression produced in the station disclosed in FIG. 3*c* is 1:2, and the rate of transversal compression produced in the station disclosed in FIG. 3*c* is 1:2. The density of the central core or body of the final plate disclosed in FIG. 5*b* is 110 kg/M$^3$. The final plate includes a single surface layer of a thickness of 17 mm and of a density of 210 kg/m$^3$. The rate of longitudinal compression of the surface layer is 1:3, and the area weight of the surface layer is 3.57 kg/m$^2$. The width of mineral fiber-insulating web produced in FIG. 1 is 1800 mm.

The production parameters used are listed in tables C and D below:

TABLE C

| Total thickness mm | A rpm/ min × 10 | B m/min | C m/min | D m/min | E m/min | F m/min |
|---|---|---|---|---|---|---|
| 50 | 58.94 | 38.90 | 19.29 | 6.43 | 12.86 | 6.43 |
| 75 | 42.65 | 49.48 | 13.96 | 4.64 | 9.31 | 4.65 |
| 100 | 33.42 | 55.47 | 10.94 | 3.65 | 7.29 | 3.65 |
| 125 | 27.47 | 59.33 | 8.99 | 3.00 | 5.99 | 3.00 |
| 150 | 23.32 | 62.03 | 7.63 | 2.54 | 5.09 | 2.54 |
| 175 | 20.26 | 64.01 | 6.63 | 2.21 | 4.42 | 2.21 |
| 200 | 17.91 | 65.54 | 5.86 | 1.95 | 3.91 | 1.95 |
| 225 | 16.04 | 66.75 | 5.25 | 1.75 | 3.50 | 1.75 |
| 250 | 14.53 | 67.73 | 4.76 | 1.59 | 3.17 | 1.59 |
| 275 | 13.28 | 68.54 | 4.35 | 1.45 | 2.90 | 1.45 |

A = Number of strokes of pendulum 104
B = Velocity of belts 42, 62", 62"', 100, 102, 104, 62, 64', 64", 64'", 66' and 66"
C = Velocity of belts 106, 108, 118", 110' and 110"
D = Velocity of belts 112', 112", 114', 114", 116, 78' and 76
E = Velocity of belts 68' and 68"
F = Velocity of belts 72', 72" and 74"

TABLE D

| Total thickness mm | G kg/m$^2$ | H kg/m$^2$ | I kg/m$^2$ | J kg/m$^2$ | K kg/m$^3$ × 10 | L Specific |
|---|---|---|---|---|---|---|
| 50 | 1.19 | 3.63 | 0.59 | 0.60 | 14.40 | 1.02 |
| 75 | 0.94 | 6.38 | 0.34 | 0.60 | 13.27 | 1.79 |
| 100 | 0.83 | 9.13 | 0.23 | 0.60 | 12.70 | 2.56 |
| 125 | 0.78 | 11.88 | 0.18 | 0.60 | 12.36 | 3.33 |
| 150 | 0.75 | 14.63 | 0.15 | 0.60 | 12.13 | 4.10 |
| 175 | 0.72 | 17.38 | 0.12 | 0.60 | 11.97 | 4.87 |
| 200 | 0.71 | 20.13 | 0.11 | 0.60 | 11.85 | 5.64 |
| 225 | 0.69 | 22.88 | 0.09 | 0.60 | 11.76 | 6.41 |
| 250 | 0.68 | 25.63 | 0.08 | 0.60 | 11.68 | 7.18 |
| 275 | 0.68 | 28.38 | 0.08 | 0.60 | 11.62 | 7.95 |

Figure 14:
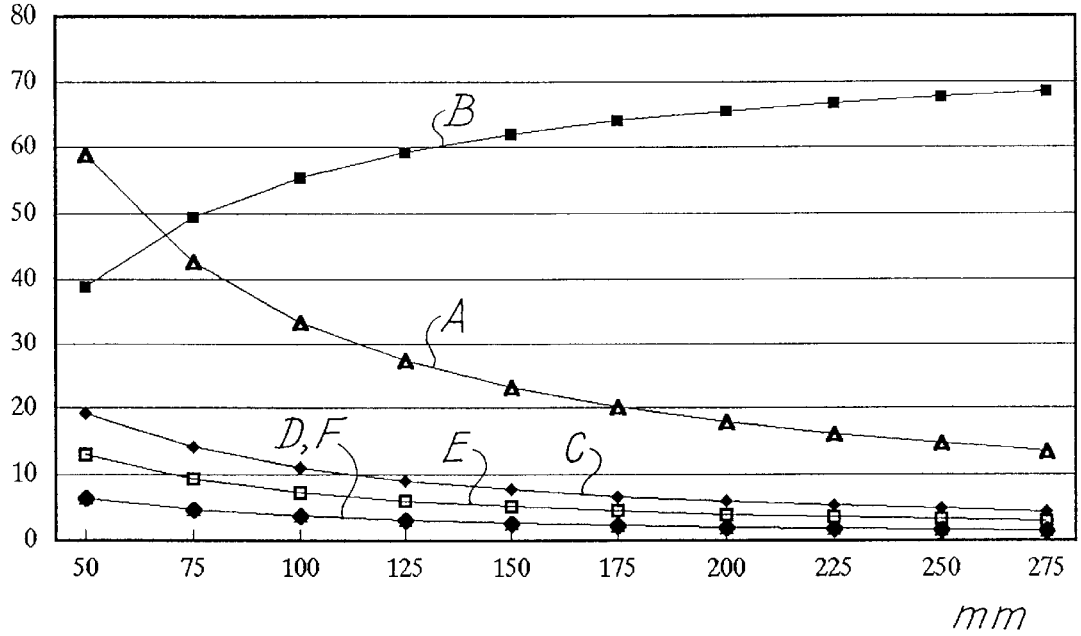
FIGS. 14 and 15 are diagrammatic views similar to the views of FIGS. 12 and 13, respectively, illustrating production parameters of an online production plant producing mineral fiber heat-insulating roofing plates from a mineral fiber-insulating web produced in accordance with the teachings of the present invention.

G = Area weight of primary mineral fiber-insulating web on belt 42
H = Area weight of central core or body after folding
I = Area weight of surface layer
J = Area weight of central core or body before transversal folding
K = Average density
L = Ratio between central core or body and surface layer In FIG. 14, a diagramme similar to the diagramme of FIG. 12 is shown, illustrating the correspondence between the parameters listed above in table C.

Figure 15:
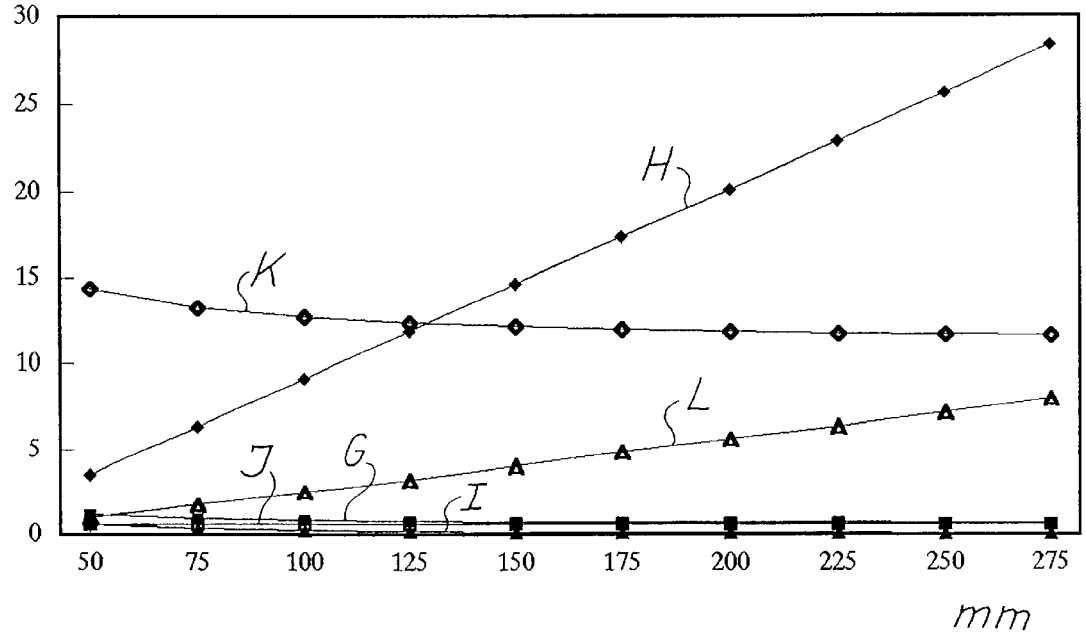

In FIG. 15, a diagramme similar to the diagramme of FIG. 13 is shown, illustrating the correspondence between the parameters listed above in table D.

EXAMPLE 3

A composite roofing plate, made from a mineral fiber-insulating web produced in accordance with the method according to the present invention as described above with reference to FIGS. 1–4, is produced in accordance with the specifications listed below:

The method comprises steps similar to the steps described above with reference to FIGS. 1, 2, 3*c* and FIG. 4. The production output of the plant is 5000 kg/h. The width of the primary web produced in the station disclosed in FIG. 2 is 1800 mm. The area weight of the low compactness and low area weight web produced in the station disclosed in FIG. 1 is 0.6 kg/m$^2$. The rate of longitudinal compression produced in the station disclosed in FIG. 3*c* is 1:2, and the rate of transversal compression produced in the station disclosed in FIG. 3*c* is 1:2. The density of the central core or body of the final plate disclosed in FIG. 5*b* is 110 kg/m$^3$. The final plate includes a single surface layer of a thickness of 17 mm and of a density of 210 kg/m$^3$. The rate of longitudinal compression of the surface layer is 1:3, and the area weight of the surface layer is 3.57 kg/m$^2$. The width of mineral fiber-insulating web produced in FIG. 1 is 900 mm.

The production parameters used are listed in tables E and F below:

TABLE E

| Total thickness mm | A rpm/ min × 10 | B m/min | C m/min | D m/min | E m/min | F m/min |
|---|---|---|---|---|---|---|
| 50 | 58.94 | 38.90 | 38.58 | 12.86 | 12.86 | 12.86 |
| 75 | 42.65 | 49.48 | 27.92 | 9.31 | 9.31 | 9.31 |
| 100 | 33.42 | 55.47 | 21.87 | 7.29 | 7.29 | 7.29 |
| 125 | 27.47 | 59.33 | 17.98 | 5.99 | 5.99 | 5.99 |
| 150 | 23.32 | 62.03 | 15.26 | 5.09 | 5.09 | 5.09 |
| 175 | 20.26 | 64.09 | 13.26 | 4.42 | 4.42 | 4.42 |
| 200 | 17.91 | 65.54 | 11.72 | 3.91 | 3.91 | 3.91 |
| 225 | 16.04 | 66.75 | 10.50 | 3.50 | 3.50 | 3.50 |
| 250 | 14.53 | 67.73 | 9.51 | 3.17 | 3.17 | 3.17 |
| 275 | 13.28 | 68.54 | 8.69 | 2.90 | 2.90 | 2.90 |

A = Number of strokes of pendulum 104
B = Velocity of belts 42, 62", 62"', 100, 102, 104, 62, 64', 64", 64'", 66' and 66"
C = Velocity of belts 106, 108, 118", 110' and 110"
D = Velocity of belts 112', 112", 114', 114", 116, 78' and 76
E = Velocity of belts 68' and 68"
F = Velocity of belts 72', 72" and 74"

TABLE F

| Total thickness mm | G kg/m$^2$ | H kg/m$^2$ | I kg/m$^2$ | J kg/m$^2$ | K kg/m$^3$ × 10 | L Specific |
|---|---|---|---|---|---|---|
| 50 | 11.90 | 3.63 | 5.90 | 6.00 | 14.40 | 1.02 |
| 75 | 9.36 | 6.38 | 3.36 | 6.00 | 13.27 | 1.79 |
| 100 | 8.35 | 9.13 | 2.35 | 6.00 | 12.70 | 2.56 |
| 125 | 7.80 | 11.88 | 1.80 | 6.00 | 12.36 | 3.33 |
| 150 | 7.46 | 14.63 | 1.46 | 6.00 | 12.13 | 4.10 |
| 175 | 7.23 | 17.38 | 1.23 | 6.00 | 11.97 | 4.87 |
| 200 | 7.06 | 20.13 | 1.06 | 6.00 | 11.85 | 5.64 |
| 225 | 6.94 | 22.88 | 0.94 | 6.00 | 11.76 | 6.41 |
| 250 | 6.84 | 25.63 | 0.84 | 6.00 | 11.68 | 7.18 |
| 275 | 6.75 | 28.38 | 0.75 | 6.00 | 11.62 | 7.95 |

Figure 16:
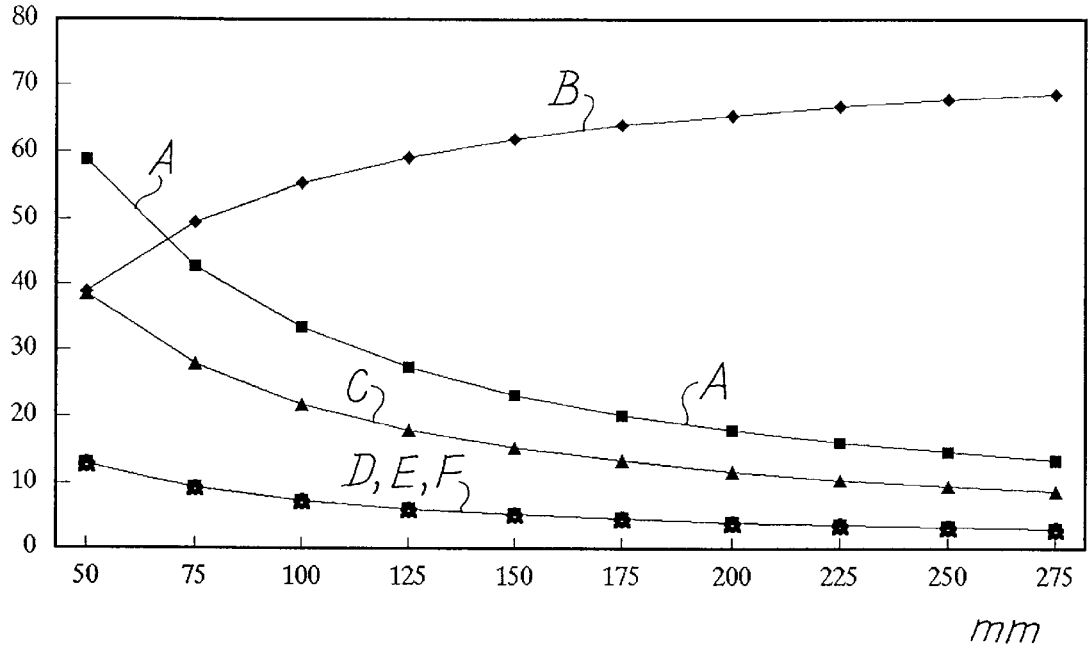
FIGS. 16 and 17 are diagrammatic views illustrating production parameters of an online production plant producing general building-insulating plates from a mineral fiber-insulating web produced in accordance with the teachings of the present invention and subjected to transversal compression as shown in FIG. 3*b*, and FIGS. 18 and 19 are diagrammatic views similar to the views of FIGS. 16 and 17, respectively, illustrating production parameters of an online production plant producing mineral fiber heat-insulating roofing plates from a mineral fiber-insulating web produced in accordance with the teachings of the present invention and subjected to transversal compression as shown in FIG. 3*b*.

G = Area weight of primary mineral fiber-insulating web on belt 42
H = Area weight of central core or body after folding
I = Area weight of surface layer
J = Area weight of central core or body before transversal folding
K = Average density
L = Ratio between central core or body and surface layer In FIG. 16, a diagramme similar to the diagramme of FIG. 12 is shown, illustrating the correspondence between the parameters listed in Table E.

Figure 17:
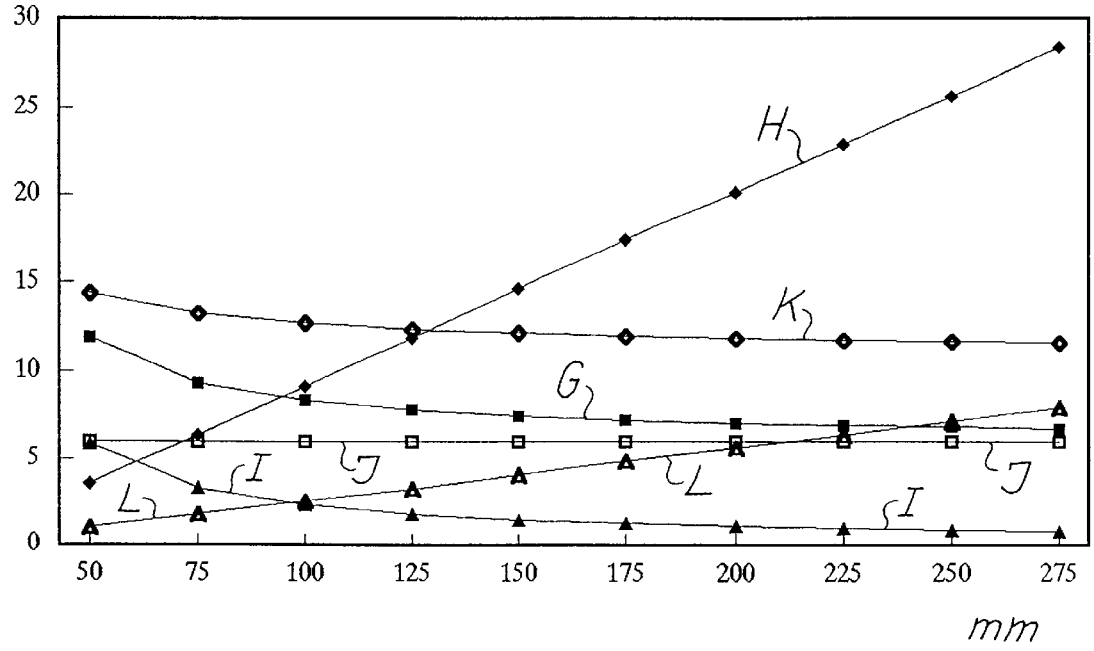

In FIG. 17, a diagramme similar to the diagramme of FIG. 13 is shown, illustrating the correspondence between the parameters listed in Table F.

EXAMPLE 4

A composite roofing plate made from a mineral fiber-insulating web produced in accordance with the method according to the present invention as described above with reference to FIGS. 1–4, is produced in accordance with the specifications listed below:

The method comprises steps similar to the steps described above with reference to FIGS. 1, 2, 3*c* and FIG. 4. The production output of the plant is 5000 kg/h. The width of the primary web produced in the station disclosed in FIG. 2 is 3600 mm. The area weight of the low compactness and low area weight web produced in the station disclosed in FIG. 1 is 0.6 kg/m$^2$. The rate of longitudinal compression produced in the station disclosed in FIG. 3*c* is 1:2, and the rate of transversal compression produced in the station disclosed in FIG. 3*c* is 1:2. The density of the central core or body of the final plate disclosed in FIG. 5*b* is 110 kg/M$^3$. The final plate includes a single surface layer of a thickness of 17 mm and of a density of 210 kg/m$^3$. The rate of longitudinal compression of the surface layer is 1:3, and the area weight of the surface layer is 3.57 kg/m$^2$. The width of mineral fiber-insulating web produced in FIG. 1 is 1800 mm.

The production parameters used are listed in tables G and H below:

TABLE G

| Total thickness mm | A rpm/min × 10 | B m/min | C m/min | D m/min | E m/min | F m/min |
|---|---|---|---|---|---|---|
| 50 | 29.47 | 19.45 | 19.29 | 6.43 | 6.43 | 6.43 |
| 75 | 21.33 | 24.74 | 13.96 | 4.65 | 4.65 | 4.65 |
| 100 | 16.71 | 27.74 | 10.94 | 3.65 | 3.65 | 3.65 |
| 125 | 13.73 | 29.67 | 8.99 | 3.00 | 3.00 | 3.00 |
| 150 | 11.66 | 31.01 | 7.63 | 2.54 | 2.54 | 2.54 |
| 175 | 10.13 | 32.01 | 6.63 | 2.21 | 2.21 | 2.21 |
| 200 | 8.95 | 32.77 | 5.86 | 1.95 | 1.95 | 1.95 |
| 225 | 8.02 | 33.37 | 5.25 | 1.75 | 1.75 | 1.75 |
| 250 | 7.27 | 33.86 | 4.76 | 1.59 | 1.59 | 1.59 |
| 275 | 6.64 | 34.27 | 4.35 | 1.45 | 1.45 | 1.45 |

A = Number of strokes of pendulum 104
B = Velocity of belts 42, 62", 62"', 100, 102, 104, 62, 64', 64", 64'", 66' and 66"
C = Velocity of belts 106, 108, 118", 110' and 110"
D = Velocity of belts 112', 112", 114', 114", 116, 78' and 76
E = Velocity of belts 68' and 68"
F = Velocity of belts 72', 72" and 74"

TABLE H

| Total thickness mm | G kg/m$^2$ | H kg/m$^2$ | I kg/m$^2$ | J kg/m$^2$ | K kg/m$^3$ × 10 | L Specific |
|---|---|---|---|---|---|---|
| 50 | 11.90 | 3.63 | 5.90 | 6.00 | 14.40 | 1.02 |
| 75 | 9.36 | 6.38 | 3.36 | 6.00 | 13.27 | 1.79 |
| 100 | 8.35 | 9.13 | 2.35 | 6.00 | 12.70 | 2.56 |
| 125 | 7.80 | 11.88 | 1.80 | 6.00 | 12.36 | 3.33 |
| 150 | 7.46 | 14.63 | 1.46 | 6.00 | 12.13 | 4.10 |
| 175 | 7.23 | 17.38 | 1.23 | 6.00 | 11.97 | 4.87 |
| 200 | 7.06 | 20.13 | 1.06 | 6.00 | 11.85 | 5.64 |
| 225 | 6.94 | 22.88 | 0.94 | 6.00 | 11.76 | 6.41 |
| 250 | 6.84 | 25.63 | 0.84 | 6.00 | 11.68 | 7.18 |
| 275 | 6.75 | 28.38 | 0.75 | 6.00 | 11.62 | 7.95 |

Figure 18:
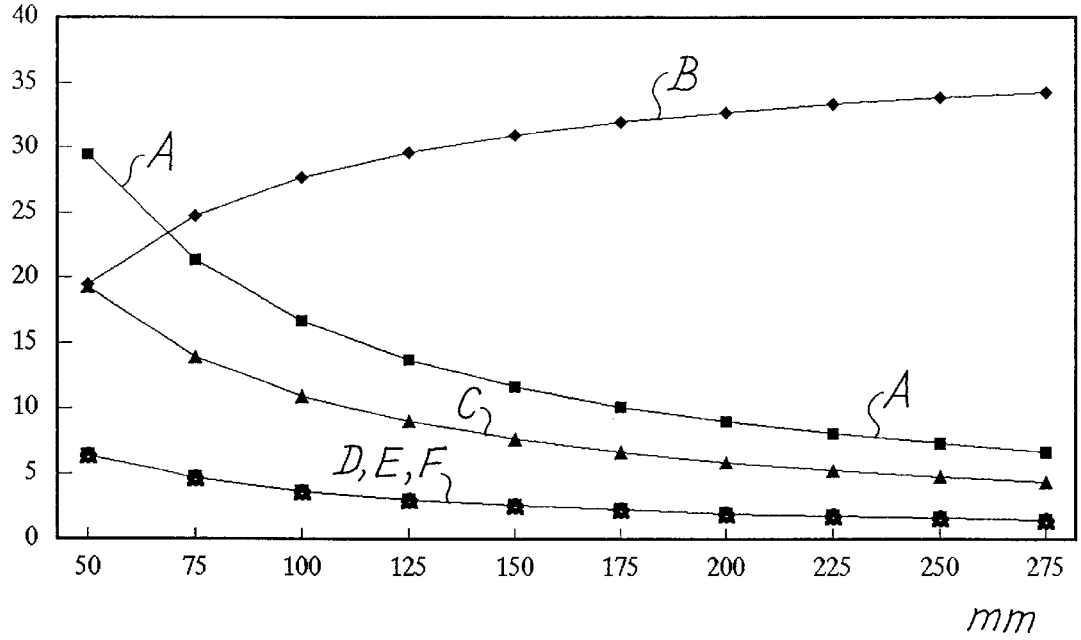

G = Area weight of primary mineral fiber-insulating web on belt 42
H = Area weight of central core or body after folding
I = Area weight of surface layer
J = Area weight of central core or body before transversal folding
K = Average density
L = Ratio between central core or body and surface layer In FIG. 18, a diagramme similar to the diagramme of FIG. 12 is shown, illustrating the correspondence between the parameters listed above in table G.

Figure 19:
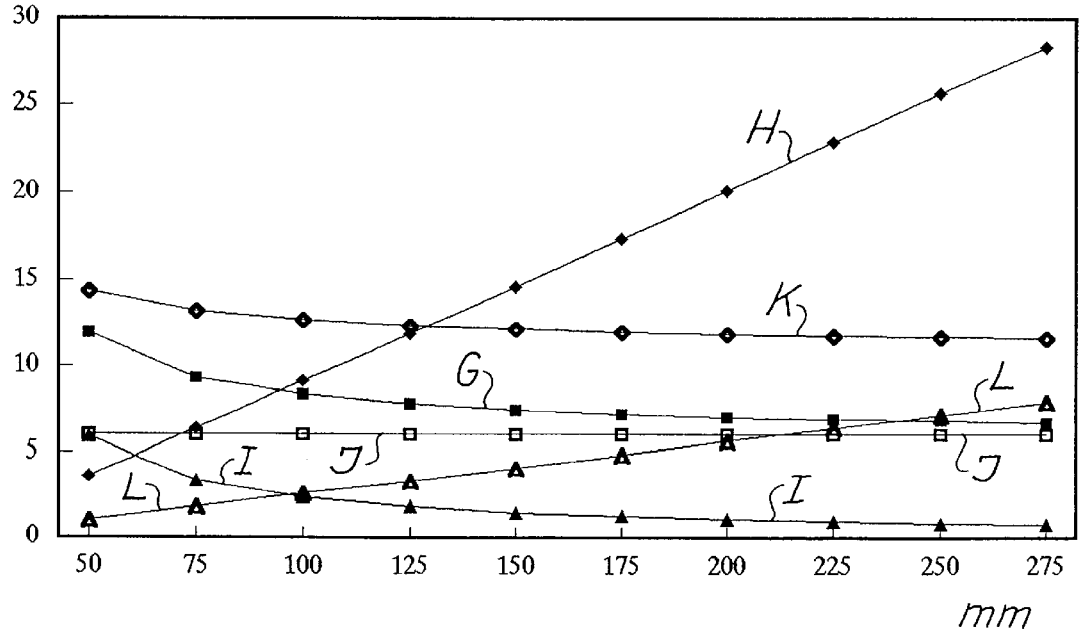

In FIG. 19, a diagramme similar to the diagramme of FIG. 13 is shown, illustrating the correspondance between the parameters listed above in table H.

EXAMPLE 5

The importance of exposing the mineral fiber-insulating web to a longitudinal and transversal compression is illustrated in the date in table I given below:

TABLE I

| | Conventional mineral fiber-insulating plates | | Mineral fiber-insulating plates according to the present invention, not being exposed to longitudinal/transversal compression | | Mineral fiber-insulating plates according to the present invention being exposed to longitudinal/transversal compression | |
|---|---|---|---|---|---|---|
| Heat-insulating plate of a density of 30 kg/m$^3$ | Pressure strength: | 2 kPa | — — — | 7 kPa | — — — | 9 kPa |
| | Modulus of elasticity: | 15 kPa | — — — | 125 kPa | — — — | 150 kPa |
| Roofing plate of a density of 150 kg/m$^3$ | Pressure strength: | 70 kPa | — — — | 180 kPa | — — — | 210 kPa |
| | Modulus of elasticity: | 600 kPa | — — — | 3300 kPa | — — — | 4000 kPa |

What is claimed is:

1. A mineral fiber-insulating plate defining a longitudinal direction and comprising:

a central body containing mineral fibers;

a surface layer containing mineral fibers, said central body and said surface layer being adjoined in facial contact with one another;

said mineral fibers of said central body being arranged generally perpendicularly to said longitudinal direction and perpendicularly to said surface layer;

said mineral fibers of said surface layer being arranged generally in a direction parallel with said longitudinal direction;

said surface layer being of a higher compactness as compared to said central body;

said mineral fibers of said central body and said mineral fibers of said surface layer being bonded together in an integral structure solely through cured bonding agents cured in a single curing process and initially present in uncured, non-woven mineral fiber webs from which said central body and said surface layer are produced; and the mineral fiber-insulating plate having a pressure strength of at least 7 kPa and a modulus of elasticity of at least 125 kPa.

2. A mineral fiber-insulating plate according to claim 1, comprising an opposite surface layer of similar structure as the surface layer, sandwiching said central body in an integral structure between the surface layer and the opposite surface layer.

3. A mineral fiber-insulating plate according to claim 2, said central body including lamellae arranged generally perpendicularly to said longitudinal direction and being interconnected through mineral fiber layers of a higher mineral fiber compactness as compared to said lamellae.

* * * * *

UNITED STATES PATENT AND TRADEMARK OFFICE

CERTIFICATE OF CORRECTION

PATENT NO. : 6,248,420 B1
DATED : June 19, 2001
INVENTOR(S) : Kim Brandt et al.

It is certified that error appears in the above-identified patent and that said Letters Patent is hereby corrected as shown below:

Title page,
Item [56], References Cited, U.S. PATENT DOCUMENTS, the following should be added:

| | | | | | |
|---|---|---|---|---|---|
| -- | 2,546,230 | 3/1951 | Modigliani | ..... | 154/92 |
| | 3,230,995 | 2/1966 | Shannon | ..... | 156/166 |
| | 3,493,452 | 2/1970 | Cole | ..... | 156/245 |
| | 4,433,992 | 2/1984 | Debouzie, et al. | ..... | 65/3.1 |
| | 4,434,299 | 2/1984 | Chang, et al. | ..... | 564/396 |
| | 4,592,769 | 1/1989 | Lemaignen | ..... | 65/4.4 |
| | 4,950,355 | 8/1990 | Klose | ..... | 156/204 |
| | 5,032,334 | 7/1991 | Jonsson, et al. | ..... | 264/113 |
| | 5,123,949 | 6/1992 | Thiessen | ……. | 65/4.4 -- |

Item [56], References Cited, FOREIGN PATENT DOCUMENTS, the following should be added:

| | | | |
|---|---|---|---|
| -- | 88/00265 | 1/1988 | (WO) |
| | 92/10602 | 6/1992 | (WO) |
| | 93/00053 | | (GB) |
| | 91/10626 | 7/1991 | (WO) |
| | 463,817 | 1/1991 | (SE) |
| | 452,150 | 11/1987 | (SE) |
| | 5317/89 | 10/1989 | (DK) |
| | 5318/89 | 10/1989 | (DK) |
| | 158,612 | 8/1982 | (DK) |
| | 155,897 | 7/1982 | (DD) |
| | 059,152 | 5/1990 | (EP) |
| | 1,151,511 | 6/1978 | (GB) |

UNITED STATES PATENT AND TRADEMARK OFFICE

CERTIFICATE OF CORRECTION

PATENT NO. : 6,248,420 B1
DATED : June 19, 2001
INVENTOR(S) : Kim Brandt et al.

It is certified that error appears in the above-identified patent and that said Letters Patent is hereby corrected as shown below:

Item [56], References Cited, FOREIGN PATENT DOCUMENTS, cont'd.

| | | |
|---|---|---|
| 2,004,204 | 3/1979 | (GB) |
| 2,004,205 | 3/1979 | (GB) |
| 2,004,206 | 3/1979 | (GB) |
| 2,026,904 | 2/1980 | (GB) |
| 2,043,489 | 10/1980 | (GB) |
| 2,118,866 | 11/1983 | (GB) |
| 2,142,844 | 1/1985 | (GB) -- |

Signed and Sealed this

Twenty-fourth Day of December, 2002

JAMES E. ROGAN
*Director of the United States Patent and Trademark Office*